US007051486B2

(12) United States Patent
Pervan

(10) Patent No.: US 7,051,486 B2
(45) Date of Patent: May 30, 2006

(54) MECHANICAL LOCKING SYSTEM FOR FLOATING FLOOR

(75) Inventor: Darko Pervan, Viken (SE)

(73) Assignee: Valinge Aluminium AB, Stockholm (SE)

( * ) Notice: Subject to any disclaimer, the term of this patent is extended or adjusted under 35 U.S.C. 154(b) by 0 days.

(21) Appl. No.: 10/413,478

(22) Filed: Apr. 15, 2003

(65) Prior Publication Data

US 2004/0016196 A1 Jan. 29, 2004

Related U.S. Application Data

(60) Provisional application No. 60/372,092, filed on Apr. 15, 2002.

(51) Int. Cl.
*E04B 5/00* (2006.01)

(52) U.S. Cl. ..... 52/586.1; 52/177; 52/584.1; 52/747.1

(58) Field of Classification Search ..... 52/586.1, 52/586.2, 585.1, 391, 177, 747.1, 584.1, 52/747.11
See application file for complete search history.

(56) References Cited

U.S. PATENT DOCUMENTS

| | | | |
|---|---|---|---|
| 213,740 | A | 4/1879 | Conner |
| 714,987 | A | 12/1902 | Wolfe |
| 753,791 | A | 3/1904 | Fuighum |
| 1,124,228 | A | 1/1915 | Houston |
| 1,194,636 | A | 8/1916 | Joy |
| 1,371,856 | A | 3/1921 | Cade |
| 1,407,679 | A | 2/1922 | Ruthrauff |
| 1,454,250 | A | 5/1923 | Parsons |
| 1,468,288 | A | 9/1923 | Een |
| 1,477,813 | A | 12/1923 | Daniels et al. |
| 1,510,924 | A | 10/1924 | Daniels et al. |
| 1,540,128 | A | 6/1925 | Houston |
| 1,575,821 | A | 3/1926 | Daniels |
| 1,602,256 | A | 10/1926 | Sellin |
| 1,602,267 | A | 10/1926 | Karwisch |
| 1,615,096 | A | 1/1927 | Meyers |
| 1,622,103 | A | 3/1927 | Fulton |
| 1,622,104 | A | 3/1927 | Fulton |
| 1,637,634 | A | 8/1927 | Carter |
| 1,644,710 | A | 10/1927 | Crooks |
| 1,660,480 | A | 2/1928 | Daniels |
| 1,714,738 | A | 5/1929 | Smith |
| 1,718,702 | A | 6/1929 | Pfiester |
| 1,734,826 | A | 11/1929 | Pick |
| 1,764,331 | A | 6/1930 | Moratz |
| 1,778,069 | A | 10/1930 | Fetz |
| 1,787,027 | A | 12/1930 | Wasleff |
| 1,790,178 | A | 1/1931 | Sutherland, Jr. |
| 1,823,039 | A | 9/1931 | Gruner |
| 1,859,667 | A | 5/1932 | Gruner |
| 1,898,364 | A | 2/1933 | Gynn |
| 1,906,411 | A | 5/1933 | Potvin |

(Continued)

FOREIGN PATENT DOCUMENTS

AU 713628 1/1998

(Continued)

OTHER PUBLICATIONS

Webster's Dictionary, Random House: New York (1987), p. 862.

(Continued)

*Primary Examiner*—Naoko Slack
(74) *Attorney, Agent, or Firm*—Buchanan Ingersoll PC

(57) ABSTRACT

Floorboards with a mechanical locking system having a separately machined strip which is mechanically joined with the floorboard.

43 Claims, 18 Drawing Sheets

U.S. PATENT DOCUMENTS

| | | | |
|---|---|---|---|
| 1,929,871 | A | 10/1933 | Jones |
| 1,940,377 | A | 12/1933 | Storm |
| 1,953,306 | A | 4/1934 | Moratz |
| 1,986,739 | A | 1/1935 | Mitte |
| 1,988,201 | A | 1/1935 | Hall |
| 2,044,216 | A | 6/1936 | Klages |
| 2,266,464 | A | 12/1941 | Kraft |
| 2,276,071 | A | 3/1942 | Scull |
| 2,324,628 | A | 7/1943 | Kahr |
| 2,398,632 | A | 4/1946 | Frost et al. |
| 2,430,200 | A | 11/1947 | Wilson |
| 2,740,167 | A | 4/1956 | Rowley |
| 2,780,253 | A | 2/1957 | Joa |
| 2,894,292 | A | 7/1959 | Gramelspacher |
| 2,947,040 | A | 8/1960 | Schultz |
| 3,045,294 | A | 7/1962 | Livezey, Jr. |
| 3,100,556 | A | 8/1963 | De Ridder |
| 3,125,138 | A | 3/1964 | Bolenbach |
| 3,182,769 | A | 5/1965 | De Ridder |
| 3,200,553 | A | 8/1965 | Frashour et al. |
| 3,203,149 | A | 8/1965 | Soddy |
| 3,267,630 | A | 8/1966 | Omholt |
| 3,282,010 | A | 11/1966 | King, Jr. |
| 3,310,919 | A | 3/1967 | Bue et al. |
| 3,347,048 | A | 10/1967 | Brown et al. |
| 3,387,422 | A | 6/1968 | Wanzer |
| 3,460,304 | A | 8/1969 | Braeuninger et al. |
| 3,481,810 | A | 12/1969 | Waite |
| 3,526,420 | A | 9/1970 | Brancalcone |
| 3,538,665 | A | 11/1970 | Gohner |
| 3,548,559 | A | 12/1970 | Levine |
| 3,553,919 | A | 1/1971 | Omholt |
| 3,555,762 | A | 1/1971 | Costanzo, Jr. |
| 3,694,983 | A | 10/1972 | Couquet |
| 3,714,747 | A | 2/1973 | Curran |
| 3,731,445 | A | 5/1973 | Hoffmann et al. |
| 3,759,007 | A | 9/1973 | Thiele |
| 3,768,846 | A | 10/1973 | Hensley et al. |
| 3,786,608 | A | 1/1974 | Boettcher |
| 3,859,000 | A | 1/1975 | Webster |
| 3,902,293 | A | 9/1975 | Witt et al. |
| 3,908,053 | A | 9/1975 | Hettich |
| 3,936,551 | A | 2/1976 | Elmendorf et al. |
| 3,988,187 | A | 10/1976 | Witt et al. |
| 4,037,377 | A | 7/1977 | Howell et al. |
| 4,084,996 | A | 4/1978 | Wheeler |
| 4,090,338 | A | 5/1978 | Bourgade |
| 4,099,358 | A | 7/1978 | Compaan |
| 4,100,710 | A | 7/1978 | Kowallik |
| 4,169,688 | A | 10/1979 | Toshio |
| 4,242,390 | A | 12/1980 | Nemeth |
| 4,299,070 | A | 11/1981 | Oltmanns et al. |
| 4,304,083 | A | 12/1981 | Anderson |
| 4,426,820 | A | 1/1984 | Terbrack et al. |
| 4,471,012 | A | 9/1984 | Maxwell |
| 4,489,115 | A | 12/1984 | Layman et al. |
| 4,501,102 | A | 2/1985 | Knowles |
| 4,561,233 | A | 12/1985 | Harter et al. |
| 4,612,074 | A | 9/1986 | Smith et al. |
| 4,612,745 | A | 9/1986 | Hovde |
| 4,641,469 | A | 2/1987 | Wood |
| 4,643,237 | A | 2/1987 | Rosa |
| 4,646,494 | A | 3/1987 | Saarinen et al. |
| 4,653,242 | A | 3/1987 | Ezard |
| 4,703,597 | A | 11/1987 | Eggemar |
| 4,715,162 | A | 12/1987 | Brightwell |
| 4,716,700 | A | 1/1988 | Hagemeyer |
| 4,738,071 | A | 4/1988 | Ezard |
| 4,769,963 | A | 9/1988 | Meyerson |
| 4,819,932 | A | 4/1989 | Trotter, Jr. |
| 4,831,806 | A | 5/1989 | Niese et al. |
| 4,845,907 | A | 7/1989 | Meek |
| 4,905,442 | A | 3/1990 | Daniels |
| 5,029,425 | A | 7/1991 | Bogataj |
| 5,113,632 | A | 5/1992 | Hanson |
| 5,117,603 | A | 6/1992 | Weintraub |
| 5,148,850 | A | 9/1992 | Urbanick |
| 5,165,816 | A | 11/1992 | Parasin |
| 5,179,812 | A | 1/1993 | Hill |
| 5,216,861 | A | 6/1993 | Meyerson |
| 5,253,464 | A | 10/1993 | Nilsen |
| 5,271,564 | A | 12/1993 | Smith |
| 5,295,341 | A | 3/1994 | Kajiwara |
| 5,349,796 | A | 9/1994 | Meyerson |
| 5,390,457 | A | 2/1995 | Sjolander |
| 5,433,806 | A | 7/1995 | Pasquali et al. |
| 5,474,831 | A | 12/1995 | Nystrom |
| 5,497,589 | A | 3/1996 | Porter |
| 5,502,939 | A | 4/1996 | Zadok et al. |
| 5,540,025 | A | 7/1996 | Takehara et al. |
| 5,567,497 | A | 10/1996 | Zegler et al. |
| 5,570,554 | A | 11/1996 | Searer |
| 5,597,024 | A | 1/1997 | Bolyard et al. |
| 5,618,602 | A | 4/1997 | Nelson |
| 5,630,304 | A | 5/1997 | Austin |
| 5,653,099 | A | 8/1997 | MacKenzie |
| 5,671,575 | A | 9/1997 | Wu |
| 5,695,875 | A | 12/1997 | Larsson et al. |
| 5,706,621 | A | 1/1998 | Pervan |
| 5,768,850 | A | 6/1998 | Chen |
| 5,797,237 | A | 8/1998 | Finkell, Jr. |
| 5,823,240 | A | 10/1998 | Bolyard et al. |
| 5,827,592 | A | 10/1998 | Van Gulik et al. |
| 5,860,267 | A | 1/1999 | Pervan |
| 5,899,038 | A | 5/1999 | Stroppiana |
| 5,900,099 | A | 5/1999 | Sweet et al. |
| 5,935,668 | A | 8/1999 | Smith |
| 5,943,239 | A | 8/1999 | Shamblin et al. |
| 5,968,625 | A | 10/1999 | Hudson |
| 5,987,839 | A | 11/1999 | Hamar et al. |
| 6,006,486 | A | 12/1999 | Moriau et al. |
| 6,023,907 | A | 2/2000 | Pervan |
| 6,029,416 | A | 2/2000 | Andersson |
| 6,094,882 | A | 8/2000 | Pervan |
| 6,101,778 | A | 8/2000 | Martensson |
| 6,119,423 | A | 9/2000 | Costantino |
| 6,134,854 | A | 10/2000 | Stanchfield |
| 6,148,884 | A | 11/2000 | Bolyard et al. |
| 6,173,548 | B1 | 1/2001 | Hamar et al. |
| 6,182,410 | B1 | 2/2001 | Pervan |
| 6,203,653 | B1 | 3/2001 | Seidner |
| 6,205,639 | B1 | 3/2001 | Pervan |
| 6,209,278 | B1 | 4/2001 | Tychsen |
| 6,216,403 | B1 | 4/2001 | Belbeoc'h |
| 6,216,409 | B1 | 4/2001 | Roy et al. |
| 6,247,285 | B1 | 6/2001 | Moebus |
| 6,254,301 | B1 * | 7/2001 | Hatch ..... 403/298 |
| 6,314,701 | B1 | 11/2001 | Meyerson |
| 6,324,803 | B1 | 12/2001 | Pervan |
| 6,332,733 | B1 | 12/2001 | Hamberger et al. |
| 6,339,908 | B1 | 1/2002 | Chuang |
| 6,345,481 | B1 | 2/2002 | Nelson |
| 6,363,677 | B1 | 4/2002 | Chen et al. |
| 6,385,936 | B1 | 5/2002 | Schneider |
| 6,397,547 | B1 | 6/2002 | Martensson |
| 6,421,970 | B1 | 7/2002 | Martensson et al. |
| 6,438,919 | B1 | 8/2002 | Knauseder |
| 6,446,405 | B1 | 9/2002 | Pervan |
| 6,490,836 | B1 | 12/2002 | Moriau et al. |
| 6,505,452 | B1 | 1/2003 | Hannig et al. |
| 6,510,665 | B1 | 1/2003 | Pervan |
| 6,516,579 | B1 | 2/2003 | Pervan |
| 6,532,709 | B1 | 3/2003 | Pervan |
| 6,536,178 | B1 | 3/2003 | Palsson et al. |

| | | | |
|---|---|---|---|
| 6,606,834 | B1 | 8/2003 | Martensson et al. |
| 6,672,030 | B1 | 1/2004 | Schulte |
| 6,684,592 | B1 | 2/2004 | Martin |
| 6,722,809 | B1 | 4/2004 | Hamberger et al. |
| 6,729,091 | B1 * | 5/2004 | Martensson ..... 52/391 |
| 6,763,643 | B1 * | 7/2004 | Martensson ..... 52/586.1 |
| 2001/0029720 | A1 | 10/2001 | Pervan |
| 2001/0034992 | A1 | 11/2001 | Pletzer et al. |
| 2002/0007608 | A1 | 1/2002 | Pervan |
| 2002/0014047 | A1 | 2/2002 | Thiers |
| 2002/0020127 | A1 | 2/2002 | Thiers et al. |
| 2002/0031646 | A1 | 3/2002 | Chen et al. |
| 2002/0046528 | A1 | 4/2002 | Pervan et al. |
| 2002/0069611 | A1 | 6/2002 | Leopolder |
| 2002/0100231 | A1 | 8/2002 | Miller et al. |
| 2002/0112433 | A1 | 8/2002 | Pervan |
| 2002/0178673 | A1 | 12/2002 | Pervan |
| 2002/0178674 | A1 | 12/2002 | Pervan |
| 2002/0178682 | A1 | 12/2002 | Pervan |
| 2003/0009972 | A1 | 1/2003 | Pervan et al. |
| 2003/0024199 | A1 | 2/2003 | Pervan et al. |
| 2003/0033777 | A1 | 2/2003 | Thiers et al. |
| 2003/0033784 | A1 | 2/2003 | Pervan |
| 2003/0041545 | A1 | 3/2003 | Stanchfield |
| 2003/0084636 | A1 | 5/2003 | Pervan |
| 2003/0115812 | A1 | 6/2003 | Pervan |
| 2003/0115821 | A1 | 6/2003 | Pervan |
| 2004/0255541 | A1 | 12/2004 | Thiers et al. |
| 2005/0034404 | A1 | 2/2005 | Pervan |
| 2005/0034405 | A1 | 2/2005 | Pervan |

FOREIGN PATENT DOCUMENTS

| | | | |
|---|---|---|---|
| AU | 200020703 | A1 | 6/2000 |
| BE | 417526 | | 9/1936 |
| BE | 0557844 | | 6/1957 |
| BE | 1010339 | A3 | 6/1998 |
| BE | 1010487 | A6 | 10/1998 |
| CA | 0991373 | | 6/1976 |
| CA | 2226286 | | 12/1997 |
| CA | 2252791 | | 5/1999 |
| CA | 2289309 | | 7/2000 |
| CH | 200949 | | 1/1939 |
| CH | 211877 | | 1/1941 |
| CH | 690242 | A5 | 6/2000 |
| DE | 1 212 275 | | 3/1966 |
| DE | 7102476 | | 1/1971 |
| DE | 1 534 278 | | 11/1971 |
| DE | 2 205 232 | | 8/1973 |
| DE | 7402354 | | 1/1974 |
| DE | 2 238 660 | | 2/1974 |
| DE | 2 252 643 | | 5/1974 |
| DE | 2 502 992 | | 7/1976 |
| DE | 2 616 077 | | 10/1977 |
| DE | 2 917 025 | | 11/1980 |
| DE | 30 41781 | A1 | 6/1982 |
| DE | 32 14 207 | A1 | 11/1982 |
| DE | 32 46 376 | C2 | 6/1984 |
| DE | 33 43 601 | A1 | 6/1985 |
| DE | 35 38 538 | A1 | 10/1985 |
| DE | 86 04 004 | | 6/1986 |
| DE | 35 12 204 | A1 | 10/1986 |
| DE | 35 44 845 | A1 | 6/1987 |
| DE | 36 31 390 | A1 | 12/1987 |
| DE | 40 02 547 | A1 | 8/1991 |
| DE | 41 30 115 | A1 | 9/1991 |
| DE | 41 34 452 | A1 | 4/1993 |
| DE | 42 15 273 | A1 | 11/1993 |
| DE | 42 42 530 | A1 | 6/1994 |
| DE | 43 13 037 | C1 | 8/1994 |
| DE | 93 17 191 | U1 | 3/1995 |
| DE | 296 10 462 | U1 | 10/1996 |
| DE | 196 01 322 | A1 | 5/1997 |
| DE | 296 18 318 | U1 | 5/1997 |
| DE | 297 10 175 | U1 | 9/1997 |
| DE | 196 51 149 | A1 | 6/1998 |
| DE | 197 09 641 | A1 | 9/1998 |
| DE | 197 18 319 | A1 | 11/1998 |
| DE | 197 18 812 | A1 | 11/1998 |
| DE | 200 01 225 | U1 | 8/2000 |
| DE | 200 02 744 | U1 | 9/2000 |
| DE | 199 25 248 | A1 | 12/2000 |
| DE | 200 13 380 | U1 | 12/2000 |
| DE | 200 17 461 | U1 | 3/2001 |
| DE | 200 18 284 | U1 | 3/2001 |
| DE | 100 01 248 | A1 | 7/2001 |
| DE | 100 32 204 | C1 | 7/2001 |
| DE | 100 44 016 | A1 | 3/2002 |
| DE | 202 05 774 | U1 | 8/2002 |
| EP | 0 248 127 | A1 | 12/1987 |
| EP | 0 623 724 | A1 | 11/1994 |
| EP | 0 652 340 | A1 | 5/1995 |
| EP | 0 665 347 | A1 | 8/1995 |
| EP | 0 690 185 | A1 | 1/1996 |
| EP | 0 698 162 | B1 | 2/1996 |
| EP | 0 843 763 | B1 | 5/1998 |
| EP | 0 849 416 | A2 | 6/1998 |
| EP | 0 855 482 | B1 | 7/1998 |
| EP | 0 877 130 | B1 | 11/1998 |
| EP | 0 958 441 | | 11/1998 |
| EP | 0 903 451 | A2 | 3/1999 |
| EP | 0 969 163 | A2 | 1/2000 |
| EP | 0 969 163 | A3 | 1/2000 |
| EP | 0 969 164 | A2 | 1/2000 |
| EP | 0 969 164 | A3 | 1/2000 |
| EP | 0 974 713 | A1 | 1/2000 |
| EP | 0 976 889 | A1 | 2/2000 |
| EP | 1 048 423 | A2 | 11/2000 |
| EP | 1 251 219 | A1 | 7/2001 |
| EP | 1 120 515 | A1 | 8/2001 |
| EP | 1 146 182 | A2 | 10/2001 |
| EP | 1 223 265 | A2 | 7/2002 |
| EP | 1 262 609 | A1 | 12/2002 |
| FI | 843060 | | 8/1984 |
| FR | 1 293 043 | | 4/1962 |
| FR | 1 568 295 | | 1/1986 |
| FR | 2 630 149 | | 10/1989 |
| FR | 2 637 932 | A1 | 4/1990 |
| FR | 2 675 174 | | 10/1992 |
| FR | 2 691 491 | | 11/1993 |
| FR | 2 697 275 | | 4/1994 |
| FR | 2 712 329 | A1 | 5/1995 |
| FR | 2 781 513 | A1 | 1/2000 |
| FR | 2 785 633 | A1 | 5/2000 |
| FR | 2 810 060 | A1 | 12/2001 |
| GB | 240629 | | 10/1925 |
| GB | 424057 | | 2/1935 |
| GB | 585205 | | 1/1947 |
| GB | 599793 | | 3/1948 |
| GB | 636423 | | 4/1950 |
| GB | 812671 | | 4/1959 |
| GB | 1127915 | | 10/1968 |
| GB | 1171337 | | 11/1969 |
| GB | 1237744 | | 6/1971 |
| GB | 1275511 | | 5/1972 |
| GB | 1430423 | | 3/1976 |
| GB | 2117813 | A | 10/1983 |
| GB | 2126106 | A | 3/1984 |
| GB | 2143381 | A | 10/1991 |
| GB | 2256023 | A | 11/1992 |
| JP | 54-65528 | | 5/1979 |
| JP | 57-119056 | | 7/1982 |
| JP | 57-185110 | | 11/1982 |
| JP | 59-186336 | | 11/1984 |
| JP | 3-169967 | | 7/1991 |

| | | | |
|---|---|---|---|
| JP | 4-106264 | | 4/1992 |
| JP | 4-191001 | | 7/1992 |
| JP | 5-148984 | | 6/1993 |
| JP | 6-56310 | | 5/1994 |
| JP | 6-146553 | | 5/1994 |
| JP | 6-320510 | | 11/1994 |
| JP | 7-076923 | | 3/1995 |
| JP | 7-180333 | | 7/1995 |
| JP | 7-300979 | | 11/1995 |
| JP | 7-310426 | | 11/1995 |
| JP | 8-109734 | | 4/1996 |
| JP | 9-38906 | | 2/1997 |
| JP | 9-88315 | | 3/1997 |
| JP | 2000 179137 | | 6/2000 |
| JP | P2000 226932 | | 8/2000 |
| JP | 2001 173213 | | 6/2001 |
| JP | 2001 179710 | | 7/2001 |
| JP | 2001 254503 | | 9/2001 |
| JP | 2001 260107 | | 9/2001 |
| JP | P2001 329681 | | 11/2001 |
| NL | 7601773 | | 8/1976 |
| NO | 157871 | | 7/1984 |
| NO | 305614 | | 5/1995 |
| PL | 24931 | U | 11/1974 |
| SE | 372 051 | | 5/1973 |
| SE | 450 141 | | 6/1984 |
| SE | 501 014 | C2 | 10/1994 |
| SE | 502 994 | | 3/1996 |
| SE | 506 254 | C2 | 11/1997 |
| SE | 509 059 | | 6/1998 |
| SE | 509 060 | | 6/1998 |
| SE | 512 290 | | 12/1999 |
| SE | 512 313 | | 12/1999 |
| SE | 0000200-6 | | 7/2001 |
| SU | 363795 | | 11/1973 |
| WO | WO 84/02155 | | 6/1984 |
| WO | WO 87/03839 | A1 | 7/1987 |
| WO | WO 92/17657 | | 10/1992 |
| WO | WO 93/13280 | | 7/1993 |
| WO | WO 94/01628 | | 1/1994 |
| WO | WO 94/26999 | | 11/1994 |
| WO | WO 96/27719 | | 9/1996 |
| WO | WO 96/27721 | | 9/1996 |
| WO | WO 96/30177 | A1 | 10/1996 |
| WO | WO 97/19232 | A1 | 5/1997 |
| WO | WO 97/47834 | | 12/1997 |
| WO | WO 98/22677 | A1 | 5/1998 |
| WO | WO 98/24994 | | 6/1998 |
| WO | WO 98/24995 | | 6/1998 |
| WO | WO 98/38401 | A1 | 9/1998 |
| WO | WO 99/40273 | A1 | 8/1999 |
| WO | WO 99/66151 | | 12/1999 |
| WO | WO 99/66152 | | 12/1999 |
| WO | WO 00/06854 | | 1/2000 |
| WO | WO 00/20705 | A1 | 4/2000 |
| WO | WO 00/20706 | A1 | 4/2000 |
| WO | WO 00/66856 | A1 | 11/2000 |
| WO | WO 01/02669 | A1 | 1/2001 |
| WO | WO 01/07729 | A1 | 2/2001 |
| WO | 01/66877 | A1 | 9/2001 |
| WO | WO 01/66876 | A1 | 9/2001 |
| WO | WO 01/75247 | A1 | 10/2001 |
| WO | WO 01/77461 | A1 | 10/2001 |
| WO | 01/98604 | A1 | 12/2001 |
| WO | WO 01/96688 | A1 | 12/2001 |
| WO | WO 01/98603 | A2 | 12/2001 |
| WO | WO 02/060691 | A1 | 8/2002 |
| WO | WO 03/016654 | A1 | 2/2003 |
| WO | WO 03/074814 | A1 | 9/2003 |
| WO | WO 04/083557 | A1 | 9/2004 |

OTHER PUBLICATIONS

Knight's American Mechanical Dictionary, Hurd and Houghton: New York (1876), p. 2051.

Opposition EP 0.698,162 B1—Facts-Grounds-Arguments, dated Apr. 1, 1999, pp. 1-56.

Opposition II EP 0.698,162 B1—Facts-Grounds-Arguments, dated Apr. 30, 1999, (17 pages)—with translation (11 pages).

Opposition I: Unilin Decor N.V./Välinge Aluminum AB, communication dated Jun. 8, 1999 to European Patent Office, pp. 1-2.

Opposition I: Unilin Decor N.V./Välinge Aluminum AB, communication dated Jun. 16, 1999 to European Patent Office, pp. 1-2.

FI Office Action dated Mar. 19, 1998.

NO Office Action dated Dec. 22, 1997.

NO Office Action dated Sep. 21, 1998.

Opposition EP 0.877,130 B1—Facts—Arguments, dated Jun. 28, 2000, pp. 1-13.

RU Application Examiner Letter dated Sep. 26, 1997.

NZ Application Examiner Letter dated Oct. 21, 1999.

European prosecution file history to grant, European Patent No. 94915725.9—2303/0698162, grant date Sep. 16, 1998.

European prosecution file history to grant, European Patent No. 98106535.2-2303/0855482, grant date Dec. 1, 1999.

European prosecution file history to grant, European Patent No. 98201555.4-2303/0877130, grant date Jan. 26, 2000.

Välinge, Fibo-Trespo Brochure, Distributed at the Domotex Fair In Hannover, Germany, Jan. 1996.

Träindustrins Handbook "Snickeriarbete", 2nd Edition, Malmö 1952, pp. 826, 827, 854, and 855, published by Teknografiska Aktiebolaget, Sweden.

"Träbearbetning", Anders Grönlund, 1986, ISBN 91-970513-2-2, pp. 357-360, published by Institutet for Trateknisk Forskning, Stockholm, Sweden.

Drawing Figure 25/6107 from Buetec Gmbh dated Dec. 16, 1985.

Pamphlet from Serexhe for Compact-Praxis, entitled "Selbst Teppichböden, PVC and Parkett verlegen", Published by Compact Verlag, München, Germany 1985, pp. 84-87.

Pamphlet from Junckers Industrser A/S entitled "Bøjlesystemet til Junckers boliggulve" Oct. 1994, , Published by Junckers Industrser A/S, Denmark.

Pamphlet from Junckers Industrser A/S entitled "The Clip System for Junckers Sports Floors", Annex 7, 1994, Published by Junckers Industrser A/S, Denmark.

Pamphlet from Junckers Industrser A/S entitled "The Clip System for Junckers Domestic Floors", Annex 8, 1994, Published by Junckers Industrser A/S, Denmark.

Fibo-Trespo Allo System Brochure entitled "Opplæring OG Autorisasjon", pp. 1-29, Fibo-Trespo.

"Revolution bei der Laminatboden-Verl", boden wand decke, vol. No. 11 of 14, Jan. 10, 1997, p. 166.

Kährs Focus Extra dated Jan. 2001, pp. 1-9.

Brochure for CLIC Laminate Flooring, Art.-Nr. 110 11 640.

Brochure for Laminat-Boden "Clever-Click", Parador® Wohnsysteme.

Brochure for PERGO®, CLIC Laminate Flooring, and Prime Laminate Flooring from Bauhaus, The Home Store, Malmö, Sweden.

Darko Pervan, U.S. Appl. No. 09/714,514 entitled "*Locking System and Flooring Board*" filed Nov. 17, 2000.

Darko Pervan et al. U.S. Appl. No. 10/235,940 entitled "*Flooring and Method for Laying and Manufacturing the Same*" filed Sep. 6, 2002.
Darko Pervan, U.S. Appl. No. 10/413,479 entitled "Floorboards for Floating Floor" filed Apr. 15, 2003.
Darko Pervan, U.S. Appl. No. 10/413,566 entitled "Floorboards with Decorative Grooves" filed Apr. 15, 2003.
Tony Pervan, U.S. Appl. No. 10/430,273 entitled "System for Joining Building Panels" filed May 7, 2003.
Darko Pervan, U.S. Appl. No. 10/730,131 entitled "Floorboards, Flooring Systems and Methods for Manufacturing and Installation Thereof" filed Dec. 9, 2003.
Darko Pervan, U.S. Appl. No. 10/768,677 entitled "Mechanical Locking System for Floorboards" filed Feb. 2, 2004.
Darko Pervan, U.S. Appl. No. 10/708,314 entitled "Floorboard and Method of Manufacturing Thereof" filed Feb. 24, 2004.
Darko Pervan, U.S. Appl. No. 10/808,455 entitled "Flooring and Method for Installation and Manufacturing Thereof" filed Mar. 25, 2004.
Darko Pervan, U.S. Appl. No. 10/908,658 entitled "Mechanical Locking System for Floor Panels" filed May 20, 2005.
Communication of Notices of Intervention by E.F.P. Floor Products dated Mar. 17, 2000 in European Patent Application 0698162, pp. 1-11 with annex pp. 1-21.
Response to the E.F.P. Floor Products intervention dated Jun. 28, 2000, pp. 1-5.
Letters from the Opponent dated Jul. 26, 2001 and Jul. 30, 2001 including Annexes 1 to 3.
Communication from European Patent Office dated Sep. 20, 2001 in European Patent No. 0698162, pp. 1-2 with Facts and Submissions Annex pp. 1-18, Minutes Annex pp. 1-11, and Annex I to VI.
Communication from Swedish Patent Office dated Sep. 21, 2001 in Swedish Patent No. 9801986-2, pp. 1-3 in Swedish with forwarding letter dated Sep. 24, 2001 in English.
Darko Pervan et al., U.S. Appl. No. 10/508,198 entitled "Floorboards with Decorative Grooves" filed Sep. 20, 2004.
Darko Pervan, U.S. Appl. No. 10/509,885 entitled "Mechanical Locking System for Floorboards" filed Oct. 4, 2004.
Darko Pervan, U.S. Appl. No. 10/958,233 entitled "Locking System for Floorboards" filed Oct. 6, 2004.
Darko Pervan, U.S. Appl. No. 10/510,580 entitled "Floorboards for Floorings" filed Oct. 8, 2004.
Darko Pervan, U.S. Appl. No. 10/970,282 entitled "Mechanical Locking System for Floor Panels" filed Oct. 22, 2004.
Darko Pervan, U.S. Appl. No. 10/975,923 entitled "Flooring Systems and Methods for Installation" filed Oct. 29, 2004.
Darko Pervan, U.S. Appl. No. 11/000,912 entitled "Floorboard, System and Method for Forming a Flooring, and Flooring Formed Thereof" filed Dec. 2, 2004.
Darko Pervan, U.S. Appl. No. 11/008,213 entitled "Metal Strip for Interlocking Floorboard and a Floorbaord Using Same" filed Dec. 10, 2004.
Darko Pervan, U.S. Appl. No. 11/034,059 entitled "Floor Covering and Locking System" Jan. 13, 2005.
Darko Pervan, U.S. Appl. No. 11/034,060 entitled "Floor Covering and Locking System" filed Jan. 13, 2005.
Darko Pervan, U.S. Appl. No. 10/906,109 entitled "Locking System and Flooring Board" filed Feb. 3, 2005.
Darko Pervan, U.S. Appl. No. 10/906,356 entitled "Building Panel with Compressed Edges and Method of Making Same" filed Feb. 15, 2005.
Darko Pervan, U.S. Appl. No. 11/092,748 entitled "Mechanical Locking System for Panels and Method of Installing Same" filed Mar. 30, 2005.
Darko Pervan et al, U.S. Appl. No. 11/161,520 entitled "Mehtod of Making a Floorboard and Method of Making a Floor with the Floorboard" filed Aug. 6, 2005.
Darko Pervan et al, U.S. Appl. No. 11/163,085 entitled "Appliance and Method for Surface Treatment of a Board Shaped Material and Floorboard" filed Oct. 4, 2005.

* cited by examiner

PRIOR ART lköää

*PRIOR ART*

*PRIOR ART*

*PRIOR ART*

T1
T3
T2
6
T4

T1
T3
T2
T4
15

T1
T3
T2
T4
15
6
6

6

15

15
6

1
1'
6
21
20
P1
P2
10
14
22
36
48
8
21a
36a
67

MECHANICAL LOCKING SYSTEM FOR FLOATING FLOOR

CROSS-REFERENCE TO RELATED APPLICATIONS

The present application claims the benefit of U.S. Provisional Application No. 60/372,092, filed in the U.S. on Apr. 15, 2002, the entire contents of which is herein incorporated by reference.

BACKGROUND OF THE INVENTION

1. Field of the Invention

The invention relates to floorboards provided with locking systems.

2. Background of the Invention

Mechanical locking systems for floorboards are disclosed in, for example, WO9426999, WO9966151, WO9966152, SE 0100100-7 and SE0100101-5, owned by Välinge Aluminium AB.

The present invention is particularly suitable for use in floating floors, which are formed of floorboards which are joined mechanically with a locking system integrated with the floorboard, i.e., mounted at the factory, and are made up of one or more upper layers of veneer, decorative laminate or decorative plastic material, an intermediate core of wood-fiber-based material or plastic material and, preferably, a lower balancing layer on the rear side of the core, and are manufactured by sawing large floor elements into floor panels. The following description of known techniques, problems of known systems and objects and features of the invention will therefore, as a non-restrictive example, be aimed above all at this field of application and in particular laminate flooring formed as rectangular floorboards intended to be mechanically joined on both long sides and short sides. However, it should be emphasized that the invention can be used in optional floorboards with optional locking systems, where the floorboards can be joined using a mechanical locking system in the horizontal and vertical directions. The invention can thus also be applicable to, for instance, homogeneous wooden floors, parquet floors with a core of wood or wood-fiber-based material and the like which are made as separate floor panels, floors with a printed and preferably also varnished surface and the like. The invention can also be used for joining, for instance, of wall panels.

Laminate flooring usually has a 6–11 mm core of fiberboard, a 0.2–0.8 mm thick upper decorative surface layer of laminate, and a 0.1–0.6 mm thick lower balancing layer of laminate, plastic, paper, or like material. The surface layer provides appearance and durability to the floorboards. The core provides stability, and the balancing layer keeps the board plane when the relative humidity (RH) varies during the year. The floorboards are laid floating, i.e., without gluing, on an existing subfloor. Conventional hard floorboards in floating flooring of this type are usually joined by means of glued tongue-and-groove joints (i.e., joints involving a tongue on one floorboard and a tongue groove on an adjoining floorboard) on the long side and the short side. When laying the floor, the boards are brought together horizontally, whereby a projecting tongue along the joint edge of one board is introduced into a tongue groove along the joint edge of an adjoining board. The same method is used on the long side as well as on the short side.

In addition to conventional floors, which are joined by means of glued tongue-and-groove joints, floorboards have recently been developed which do not require the use of glue and instead are joined mechanically by means of so-called mechanical locking systems. These mechanical locking systems lock the boards horizontally and vertically. The mechanical locking systems are usually formed by machining of the core of the board. Alternatively, parts of the locking system can be formed of a separate material, for instance aluminum, which is integrated with the floorboard, i.e., joined with the floorboard, in connection with the manufacture thereof, for example.

An advantage of floating floors with mechanical locking systems is that the floating floors can easily and quickly be laid by various combinations of inward angling and snapping-in. The floating floors can also easily be taken up again and used once more at a different location. A further advantage of the mechanical locking systems is that the edge portions of the floorboards can be made of materials which need not have good gluing properties. The most common core material is a fiberboard with high density and good stability, such as HDF—High Density Fiberboard. Sometimes also MDF—Medium Density Fiberboard—is used as core.

Laminate flooring and also many other floorings with a surface layer of plastic, wood, veneer, cork, and the like are made by the surface layer and the balancing layer being applied to a core material. This application may take place by gluing a previously manufactured decorative layer, for instance when the fiberboard is provided with a decorative high pressure laminate which is made in a separate operation where a plurality of impregnated sheets of paper are compressed under high pressure and at a high temperature. A conventional method when making laminate flooring, however, is direct laminating which is based on a more modern principle where both manufacture of the decorative laminate layer and the fastening to the fiberboard take place in one and the same manufacturing step. Impregnated sheets of paper are applied directly to the board and pressed together under pressure and heat without any gluing.

In addition to these two methods, a number of other methods are used to provide the core with a surface layer. A decorative pattern can be printed on the surface of the core, which is then, for example, coated with a wear layer. The core can also be provided with a surface layer of wood, veneer, decorative paper, or plastic sheeting, and these materials can then be coated with a wear layer.

The above methods result in a floor element in the form of a large board which is then sawn into, for instance, a plurality of floor panels, e.g.,some ten floor panels, which are then machined to floorboards. The above methods can, in some cases, result in completed floor panels. In that case, sawing is then not necessary before the machining to completed floorboards is carried out. Manufacture of individual floor panels usually takes place when the panels have a surface layer of wood or veneer.

The above floor panels are individually machined along their edges to floorboards. The machining of the edges is carried out in advanced milling machines where the floor panel is exactly positioned between one or more chains and bands mounted so that the floor panel can be moved at high speed and with great accuracy past a number of milling motors, which are provided with diamond cutting tools or metal cutting tools, which machine the edge of the floor panel. By using several milling motors operating at different angles, advanced joint geometries can be formed at speeds exceeding 100 m/min and with an accuracy of ±0.02 mm.

Definitions of Some Terms

In the following text, the top visible surface of the installed floorboard is called "front side", while the opposite side of the floorboard, facing the subfloor, is called "rear side". The sheet-shaped starting material that is used is called "core". When the core is coated with a surface layer closest to the front side and preferably also a balancing layer closest to the rear side, it forms a semimanufacture which is called a "floor element". In the case where the "floor element" in a subsequent operation is divided into a plurality of panels, each of the panels are called a "floor panel". When the floor panels are machined along their edges so as to obtain their final shape with the locking system, they are called "floorboards". By "surface layer" are meant all layers applied to the core closest to the front side and covering preferably the entire front side of the floorboard. By "decorative surface layer" is meant a layer which is mainly intended to give the floor its decorative appearance. "Wear layer" relates to a layer which is mainly adapted to improve the durability of the front side. In laminate flooring, this layer includes a transparent sheet of paper with an admixture of aluminum oxide which is impregnated with melamine resin. By "reinforcement layer" is meant a layer which is mainly intended to improve the capability of the surface layer of resisting impact and pressure and, in some cases, compensating for the irregularities of the core so that these will not be visible at the surface. In high pressure laminates, this reinforcement layer usually includes brown kraft paper which is impregnated with phenol resin. By "horizontal plane" is meant a plane which extends parallel with the outer part of the surface layer. Immediately juxtaposed upper parts of two neighboring joint edges of two joined floorboards together define a "vertical plane" perpendicular to the horizontal plane.

The outer parts of the floorboard at the edge of the floorboard between the front side and the rear side are called "joint edge". The joint edge has several "joint surfaces" which can be vertical, horizontal, angled, rounded, beveled etc. These joint surfaces exist on different materials, for instance laminate, fiberboard, wood, plastic, metal (especially aluminum) or sealing material. By "joint edge portion" are meant the top joint edge of the floorboard and part of the floorboard portions closest to the joint edge.

By "joint" or "locking system" are meant coacting connecting means which connect the floorboards vertically and/or horizontally. By "mechanical locking system" is meant that joining can take place without glue. Mechanical locking systems can in many cases also be joined by gluing.

The above techniques can be used to manufacture laminate floorings which are highly natural copies of wooden flooring, stones, tiles, and the like, and which are very easy to install using mechanical locking systems. The length and width of the floorboards are about 1.2*0.2 m. Recently also laminate floorings in other formats are being marketed. The techniques used to manufacture such floorboards with mechanical locking systems, however, are still relatively expensive since the machining of the joint portions for the purpose of forming the mechanical locking system causes considerable amounts of wasted material, in particular when the width of the floorboards is reduced so that the length of the joint portions per square meter of floor surface increases. It should be possible to manufacture new formats and to increase the market for these types of flooring significantly if the mechanical locking systems could be made in a simpler and less expensive manner and with improved function.

Conventional Techniques and Problems Thereof

The following facilitates the understanding and the description of the present invention as well as the knowledge of the problems behind the invention. Both the basic construction and the function of floorboards according to WO 9426999, as well as the manufacturing principles for manufacturing laminate flooring and mechanical locking systems in general, will now be described with reference to FIGS. 1–8 in the accompanying drawings. In applicable parts, the subsequent description also applies to the embodiments of the present invention that will be described below.

FIGS. 3*a* and 3*b* show a floorboard 1 according to WO 9426999 from above and from below, respectively. The board 1 is rectangular and has an upper side 2, a lower side 3, two opposite long sides with joint edge portions 4*a* and 4*b*, respectively, and two opposite short sides with joint edge portions 5*a* and 5*b*, respectively.

Both the joint edge portions 4*a*, 4*b* of the long sides and the joint edge portions 5*a*, 5*b* of the short sides can be joined mechanically without glue in a direction D2 in FIG. 1*c*, so as to meet in a vertical plane VP (marked in FIG. 2*c*) and in such manner that, when installed, they have their upper sides in a common horizontal plane HP (marked in FIG. 2*c*).

In the embodiment shown in FIGS. 1–3, which is an example of floorboards according to WO 9426999, the board 1 has a factory-mounted flat strip 6, which extends along the entire long side 4*a* and which is made of a bendable, resilient aluminum sheet. The strip 6 extends outwards past the vertical plane VP at the joint edge portion 4*a*. The strip 6 can be mechanically attached according to the shown embodiment or by gluing or in some other way. It is possible to use as material for the strip, which is attached to the floorboard at the factory, other strip materials, such as a sheet of some other metal, aluminum or plastic sections. As is also stated in WO 9426999, the strip 6 can instead be formed integrally with the board 1, for instance by suitable machining of the core of the board 1.

Embodiments of the present invention are usable for floorboards where the strip or at least part thereof is formed in one piece with the core, and these embodiments address special problems that exist in such floorboards and the manufacture thereof. The core of the floorboard need not be, but is preferably, made of a uniform material. The strip 6, however, is integrated with the board 1, i.e., it should be formed on the board or be factory mounted.

A similar, although shorter strip 6' is arranged along one short side 5*a* of the board 1. The part of the strip 6 projecting past the vertical plane VP is formed with a locking element 8 which extends along the entire strip 6. The locking element 8 has in the lower part an operative locking surface facing the vertical plane VP and having a height of, e.g., 0.5 mm. During laying, this locking surface 10 coacts with a locking groove 14 which is formed in the underside 3 of the joint edge portion 4*b* on the opposite long side of an adjoining board 1'. The strip 6' along one short side is provided with a corresponding locking element 8', and the joint edge portion 5*b* of the opposite short side has a corresponding locking groove 14'. The edge of the locking grooves 14, 14' facing away from the vertical plane VP forms an operative locking surface 10' for coaction with the operative locking surface 10 of the locking element.

For mechanical joining of long sides as well as short sides also in the vertical direction (direction D1 in FIG. 1*c*), the board 1 is also along one long side (joint edge portion 4*a*) and one short side (joint edge portion 5*a*) formed with a laterally open recess or groove 16. This is defined upwards by an upper lip at the joint edge portion 4*a*, 5*a* and downwards by the respective strips 6, 6'. At the opposite edge portions 4*b* and 5*b* there is an upper milled-out portion 18 which defines a locking tongue 20 coacting with the recess or groove 16 (see FIG. 2*a*).

FIGS. 1*a*–1*c* show how two long sides 4*a*, 4*b* of two such boards 1, 1' on a base can be joined by downward angling by turning about a center close to the intersection between the horizontal plane HP and the vertical plane VP while the boards are held essentially in contact with each other.

FIGS. 2*a*–2*c* show how the short sides 5*a*, 5*b* of the boards 1, 1' can be joined by snap action. The long sides 4*a*, 4*b* can be joined by means of both methods, while the joining of the short sides 5*a*, 5*b*—after laying the first row of floorboards—is normally carried out merely by snap action, after joining of the long sides 4*a*, 4*b*.

When a new board 1' and a previously installed board 1 are to be joined along their long side edge portions 4*a*, 4*b* according to FIGS. 1*a*–1*c*, the long side edge portion 4*b* of the new board 1' is pressed against the long side edge portion 4*a* of the previously installed board 1 according to FIG. 1*a*, so that the locking tongue 20 is inserted into the recess or groove 16., The board 1' is then angled down towards the subfloor according to FIG. 1*b*. The locking tongue 20 enters completely the recess or groove 16 while at the same time the locking element 8 of the strip 6 snaps into the locking groove 14. During this downward angling, the upper part 9 of the locking element 8 can be operative and perform guiding of the new board 1' towards the previously installed board 1.

In the joined position according to FIG. 1*c*, the boards 1, 1' are certainly locked in the D1 direction as well as the D2 direction along their long side edge portions 4*a*, 4*b*, but the boards 1, 1' can be displaced relative to each other in the longitudinal direction of the joint along the long sides (i.e., direction D3).

FIGS. 2*a*–2*c* show how the short side edge portions 5*a* and 5*b* of the boards 1, 1' can be mechanically joined in the D1 direction as well as the D2 direction by the new board 1' being displaced essentially horizontally towards the previously installed board 1. In particular, this can be done after the long side of the new board 1' by inward angling according to FIGS. 1*a*–*c* has been joined with a previously installed board 1 in a neighboring row. In the first step in FIG. 2*a*, beveled surfaces adjacent to the recess 16 and the locking tongue 20, respectively, coact so that the strip 6' is forced downwards as a direct consequence of the joining of the short side edge portions 5*a*, 5*b*. During the final joining, the strip 6' snaps upwards when the locking element 8' enters the locking groove 14', so that the operative locking surfaces 10, 10' of the locking element 8' and the locking groove 14', respectively, come into engagement with each other.

By repeating the operations illustrated in FIGS. 1*a*, 1*c* and 2*a*–*c*, the entire installation can be made without gluing and along all joint edges. Thus, floorboards of the above-mentioned type can be joined mechanically by first being angled down on the long side and once the long side is locked, by snapping together the short sides by horizontal displacement of the new board 1' along the long side of the previously installed board 1 (direction D3). The boards 1, 1' can, without the joint being damaged, be taken up again in reverse order of installation and then be laid once more. Parts of these laying principles are applicable also in connection with embodiments of the present invention.

The locking system enables displacement along the joint edge in the locked position after an optional side has been joined. Therefore laying can take place in many different ways which are all variants of the three basic methods: Angling of long side and snapping-in of short side; snapping-in of long side-snapping-in of short side; and angling of short side, upward angling of two boards, displacement of the new board along the short side edge of the previous board and finally downward angling of two boards.

One laying method is that the long side is first angled downwards and locked against another floorboard. Subsequently, a displacement in the locked position takes place towards the short side of a third floorboard so that the snapping-in of the short side can take place. Laying can also be made by one side, e.g., a long side or a short side, being snapped together with another board. Then a displacement in the locked position takes place until the other side snaps together with a third board. These two methods snap-in at least one side. However, laying can also take place without snap action. The third alternative is that the short side of a first board is angled inwards first towards the short side of a second board, which is already joined on its long side with a third board. After this joining-together, the first and the second board are slightly angled upwards. The first board is displaced in the upwardly angled position along its short side until the upper joint edges of the first and the third board are in contact with each other, after which the two boards are jointly angled downwards.

The above-described floorboard and its locking system have become very successful on the market. A number of variants of this locking system are available on the market, in connection with laminate floors and also thin wooden floors with a surface of veneer and parquet floors.

FIGS. 5*a*–5*e* show manufacture of a laminate floor. FIG. 5*a* shows manufacture of high pressure laminate. A wear layer 34 of a transparent material with great wearing strength is impregnated with melamine with aluminum oxide added. A decorative layer 35 of paper impregnated with melamine is placed under this layer 34. One or more reinforcing layers 36*a*, 36*b* of core paper impregnated with phenol are placed under the decorative layer 35 and the entire packet is placed in a press where it cures under pressure and heat to an about 0.5–0.8 mm thick surface layer 31 of high pressure laminate. FIG. 5*c* shows how this surface layer 31 can then be glued together with a balancing layer 32 to a core 30 to constitute a floor element 3.

FIGS. 5*d* and 5*e* illustrate direct lamination. A wear layer 34 in the form of an overlay and a decorative layer 35 of decoration paper is placed directly on a core 30, after which all three parts and, as a rule, also a rear balancing layer 32 are placed in a press where they cure under heat and pressure to a floor element 3 with a decorative surface layer 31 having a thickness of about 0.2 mm.

After lamination, the floor element is sawn into floor panels. When the mechanical locking system is made in one piece with the core of the floorboard, the joint edges are formed in the subsequent machining to mechanical locking systems of different kinds which all lock the floorboards in the horizontal D2 and vertical D1 directions.

FIGS. 4*a*–*d* show in four steps manufacture of a floorboard. FIG. 4*a* shows the three basic components surface layer 31, core 30 and balancing layer 32. FIG. 4*b* shows a floor element 3 where the surface layer and the balancing layer have been applied to the core. FIG. 4*c* shows how floor panels 2 are made by dividing the floor element. FIG. 4*d* shows how the floor panel 2 after machining of its edges obtains its final shape and becomes a complete floorboard 1 with a locking system 7, 7', which in this case is mechanical, on the long sides 4*a*, 4*b*.

FIGS. 6*a*–8*b* show variants of mechanical locking systems which are formed by machining the core of the floorboard. FIGS. 6*a, b* illustrate a system which can be angled and snapped. FIGS. 7*a, b* show a snap joint. FIGS. 8*a, b* show a joint which can be angled and snapped but which has less strength and a poorer function than the locking system according to FIG. 6. As shown in these figures, the mechanical locking systems have parts which project past the upper joint edges and this causes expensive waste (w), owing to the removing of material performed by the sawblade SB when dividing the floor element and when surface material is removed and the core is machined in connection with the forming of the parts of the locking system.

These systems and the manufacturing methods suffer from a number of drawbacks which are above all related to cost and function.

For example, the aluminum oxide and also the reinforcing layers which give the laminate floor its high wearing strength and impact resistance causes great wear on the tools, such as the diamond teeth. Frequent and expensive regrinding is made particularly of the tool parts that remove the surface layer.

Also, machining of the joint edges causes expensive waste when core material and surface material are removed to form the parts of the locking system.

Further, to be able to form a mechanical locking system with projecting parts, the width of the floorboard is increased and the decoration paper is in many cases adjusted as to width. This may result in production problems and considerable investments especially when manufacturing parquet flooring.

In addition, a mechanical locking system has a more complicated geometry than a locking system which is joined by gluing. The number of milling motors is usually increased, which requires that new and more advanced milling machines be provided.

To satisfy the requirements as to strength, flexibility in connection with snapping-in, and low friction in connection with displacement in the locked position, the core is of high quality. Such quality requirements, which are used for the locking system, are not always used for the other properties of the floor, such as stability and impact strength. Owing to the locking system, the core of the entire floorboard is of unnecessarily high quality, which increases the manufacturing cost.

To counteract these problems, different methods have been used. One method is to limit the extent of the projecting parts past the upper joint edge. This usually causes poorer strength and difficulties in laying or detaching the floorboards. Another method is to manufacture parts of the locking system of another material, such as aluminum sheet or aluminum sections. These methods may result in great strength and good function but are generally more expensive. In some cases, these methods may result in a somewhat lower cost than a machined embodiment, but this implies that floorboards are expensive to manufacture and that the waste is very costly, as may be the case when the floorboards are made of, for example, high quality high pressure laminate. In less expensive floorboards of low pressure laminate, the cost of these locking systems of metal is higher than in the case where the locking system is machined from the core of the board. The investment in special equipment to form and attach the aluminum strip to the joint edge of the floorboard may be considerable.

It is also known that separate materials can be glued as an edge portion and formed by machining in connection with further machining of the joint edges. Gluing is difficult and machining is not simple.

Floorboards can also be joined by means of separate loose clamps of metal which, in connection with laying, are joined with the floorboard. This results in laborious laying and the manufacturing costs is high. Clamps are usually placed under the floorboard and fixed to the rear side of the floorboard. They are not convenient for use in thin flooring. Examples of such clamps are described in DE 42 15 273 and U.S. Pat. No. 4,819,932. Fixing devices of metal are disclosed in U.S. Pat. No. 4,169,688, U.S. Pat. No. 5,295,341, DE 33 43 601 and JP 614,553. All these alternatives have a poor function and are more expensive to manufacture and use than known machined locking systems. WO 96/27721 discloses separate joint parts which are fixed to the floorboard by gluing. This is an expensive and complicated method.

OBJECTS AND SUMMARY

An object of the present invention is to eliminate or significantly reduce one or more of the problems occurring in connection with manufacture of floorboards with mechanical locking systems. This is applicable in particular to such floorboards with mechanical locking systems as are made in one piece with the core of the floorboard. A further object of the invention is to provide a rational and cost-efficient manufacturing method for manufacturing elements which are later to constitute parts of the mechanical locking system of the floorboards. A third object is to provide a rational method for joining of these elements with the joint portion of the floorboard to form an integrated mechanical locking system which locks vertically and horizontally.

According to one embodiment of the invention, parts of the mechanical locking system should be made of a separate strip which may have other properties than the floorboard core, which does not contain expensive surface layers that are difficult to machine, and that can be made of a board material thinner than the core of the floorboard. This makes it possible to reduce the amount of wasted material and the locking system can be given better properties specially adjusted to function and strength requirements on the long side and the short side.

According to another embodiment of the invention, the separate strip is preferably made of a sheet-shaped material which by machining can be given its final shape in a cost-efficient manner and with great accuracy.

According to a further embodiment of the invention, the strip can be integrated with the joint edge portion of the floorboard in a rational manner with great accuracy and strength, preferably by mechanical joining where a preferred alternative may involve snapping-in the core of the floorboard essentially parallel to the horizontal plane of the floorboard. The mechanical joining between the floorboard and the separate strip should preferably enable a relative movement between the floorboard and the separate strip along the joint edge. In this way, it may be possible to eliminate tensions in the cases where the floorboard and the strip move differently owing to the moisture and heat movements of different materials. The mechanical joining gives great degrees of freedom when selecting materials since there does not exist any gluing problem.

According to still further embodiment of the invention, machining of the edges of the floorboards can be made in a simpler and quicker manner with fewer and simpler tools which are both less expensive to buy and less expensive to grind, and that more advanced joint geometries can be provided if the manufacture of the locking system is made by machining a separate strip which can be formed of a sheet-shaped material with good machining properties. This separate strip can, after machining, be integrated with the floorboard in a rational manner.

According to still another embodiment of the invention, the flexibility of the strip in connection with snapping-in of the floorboards against each other can be improved by the strip being made of a material which has better flexibility than the core of the floorboard and by the separate strip being able to move in the snap joint.

According to yet another embodiment of the invention, several strips are made in the same milling operation and are made in such manner that they are joined with each other to form a strip blank. In this way, the strips can be made, handled, separated and integrated with the floorboard in a rational and cost-efficient manner and with great accuracy.

The different embodiments are particularly suited for use in floorboards whose locking system comprises a separate strip which is machined from a sheet-shaped material, preferably containing wood fibers, for instance particle board, MDF, HDF, compact laminate, plywood, and the like. Such board materials can be machined efficiently and with great accuracy and dimensional stability. They can also be, for instance, impregnated with suitable chemicals in connection with the manufacture of the board material or, alternatively, impregnated before or after machining, when they have been formed to strip blanks or strips. In addition, they can be given improved properties, for instance regarding strength, flexibility, moisture resistance, friction, and the like. The strips can also be colored for decoration. Different colors can be used for different types of floors. The board material may also include different plastic materials which by machining are formed to strips. Special board materials can be made by gluing or lamination of, for instance, different layers of wood fiberboards and plastic material. Such composite materials can be adjusted so as to give, in connection with the machining of the strips, improved properties in, for instance, joint surfaces which are subjected to great loads or which should have good flexibility or low friction. It is also possible to form strips as sections by extrusion of plastic or metal, for instance aluminum, but this may be more expensive than machining. The rate of production is only a fraction of the rates that can be achieved in modern working machines.

The strips may include the same material as the core of the floorboard, or include the same type of material as the core, but of a different quality, or of a material quite different from that of the core.

The strips can also be formed so that part thereof is visible from the surface and constitutes a decorative portion.

The strips can also have a sealant or sealer preventing penetration of moisture into the core of the floorboard or through the locking system.

The strips can be positioned on a long side and a short side or only on one side. The other side may have some other traditional or mechanical locking system.

The strips on the long side and the short side can be made of the same material and have the same geometry, but they may also include different materials and have different geometries. They can be particularly adjusted to different requirements as to function, strength and cost that are placed on the locking systems on the different sides. The long side contains, for example, more joint material than the short side and is usually laid by laying. At the short side the strength requirements are greater and joining often takes place by snapping-in which requires flexible and strong joint materials.

The shape of the floorboard can be rectangular or square. Embodiments of the invention are particularly suited for narrow floorboards or floorboards having the shape of, e.g., parquet blocks. Floors with such floorboards contain many joints and separate joint parts and can therefore yield great savings. Embodiments of the invention are also particularly suited for thick laminate flooring, for instance 10–12 mm, where the cost of waste is high and for parquet flooring, such as 15 mm parquet flooring, with a core of wooden slats, where it is difficult to form a locking system by machining wood material along and transversely of the direction of the fibers. A separate strip can give considerable advantages as to cost and a better function.

It is also not necessary for the strip to be located along the entire joint edge. The long side or the short side can, for instance, have joint portions that do not contain separate joint parts. In this manner, additional cost savings can be achieved, especially in the cases where the separate strip is of high quality, for instance compact laminate.

The separate strip may constitute part of the horizontal and vertical joint, but it may also constitute merely part of the horizontal or the vertical joint.

Thus, a number of combinations of different locking systems, materials and formats can be provided. It should be particularly pointed out that the mechanical joining between the floorboard and the separate strip may also include a glue joint which improves joining. The mechanical joining can then, for instance, be used to position the joint part and/or to hold it in the correct position until the glue cures.

According to a first aspect of the invention, a locking system for mechanical joining of floorboards is thus provided, where immediately juxtaposed upper parts of two neighboring joint edges of two joined floorboards together define a vertical plane which is perpendicular to the principal plane of the floorboards. To perform joining of the two joint edges in the horizontal direction perpendicular to the vertical plane and parallel to the principal plane, the locking system comprises a locking groove formed in the joint edge portion and extended parallel to the first joint edge, and a separate strip which is integrated with the second joint edge and which has a projecting portion which at a distance from the vertical plane supports a locking element coacting with the locking groove, said projecting portion thus being located completely outside the vertical plane seen from the side of the second joint edge. The separate strip is formed by machining a sheet-shaped material. The separate strip with its projecting portion is joined with the core of the floorboard using a mechanical snap joint which joins the separate strip with the floorboard in the horizontal and vertical direction, that snapping-in can take place by relative displacement of the strip and the joint edge of the floorboard towards each other.

According to a second aspect of the invention, a strip blank is provided, which is intended as a semimanufacture for making floorboards with a mechanical locking system which locks the floorboards vertically and horizontally. The strip blank includes a sheet-shaped blank intended for machining. The strip blank includes at least two strips which constitute the horizontal joint in the locking system.

According to a third aspect of the invention, there is provided a method of providing rectangular floorboards, which have machined joint portions, with a mechanical locking system which locks the floorboards horizontally and vertically on at least two opposite sides, said locking system including at least one separate strip.

The strip is made by machining of a sheet-shaped material and is joined with the joint portion mechanically in the horizontal direction and in the vertical direction perpendicular to the principal plane. The mechanical joining takes place by snapping-in relative to the joint edge.

BRIEF DESCRIPTION OF THE DRAWINGS

FIGS. 15*a–d* show an embodiment of a production-adjusted floorboard and joining of floorboards by inward angling and snapping-in.

DETAILED DESCRIPTION OF PREFERRED EMBODIMENTS

A first preferred embodiment of a floorboard 1, 1' provided with a mechanical locking system according to the invention will now be described with reference to the embodiments shown in FIGS. 9*a–d*. To facilitate understanding, the locking system is shown schematically. It should be emphasized that an improved function can be achieved using other preferred embodiments that will be described below.

Figure 1A:
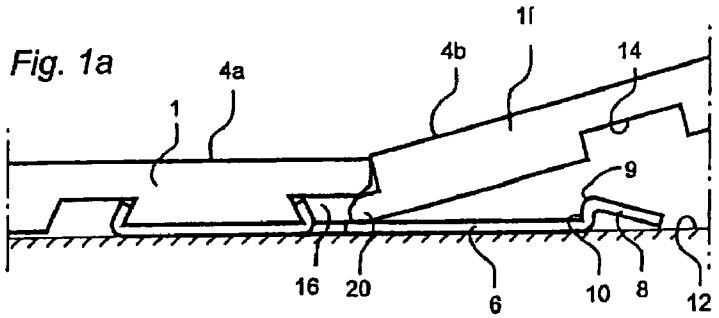
FIGS. 1*a–c* illustrate different steps of mechanical joining of conventional floorboards.
Figure 1B:
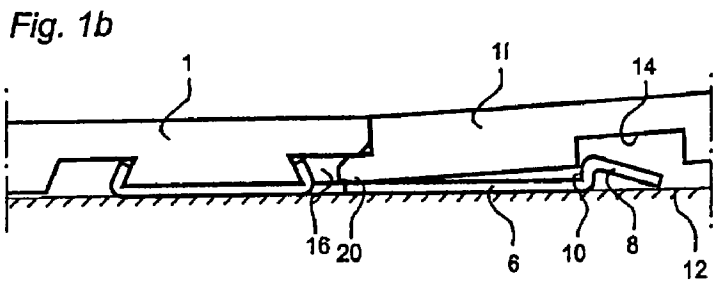
Figure 1C:
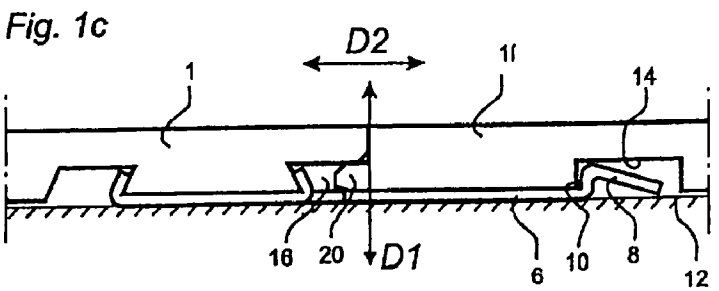
Fig. 1c PRIOR ART
Figure 2A:
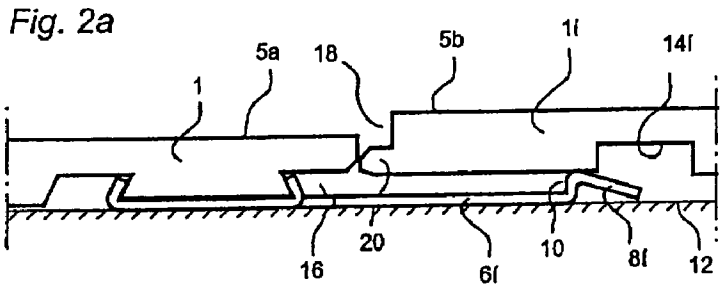
FIGS. 2*a–c* illustrate different steps of mechanical joining of conventional floorboards.
Figure 2B:
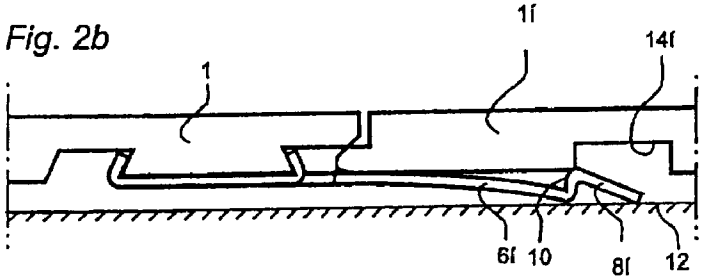
Figure 2C:
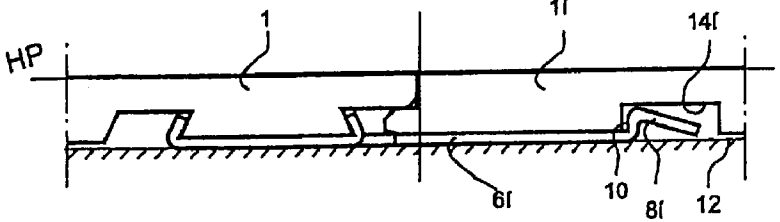
Fig. 2c PRIOR ART
Figure 3A:
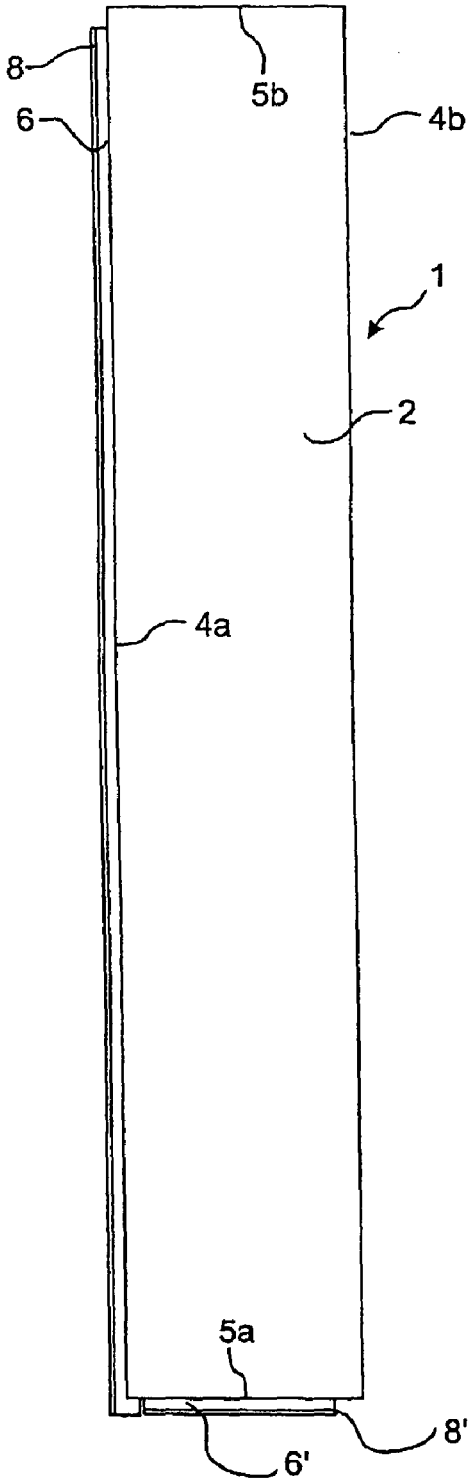
FIGS. 3*a–b* show floorboards with a conventional mechanical locking system.
Figure 3B:
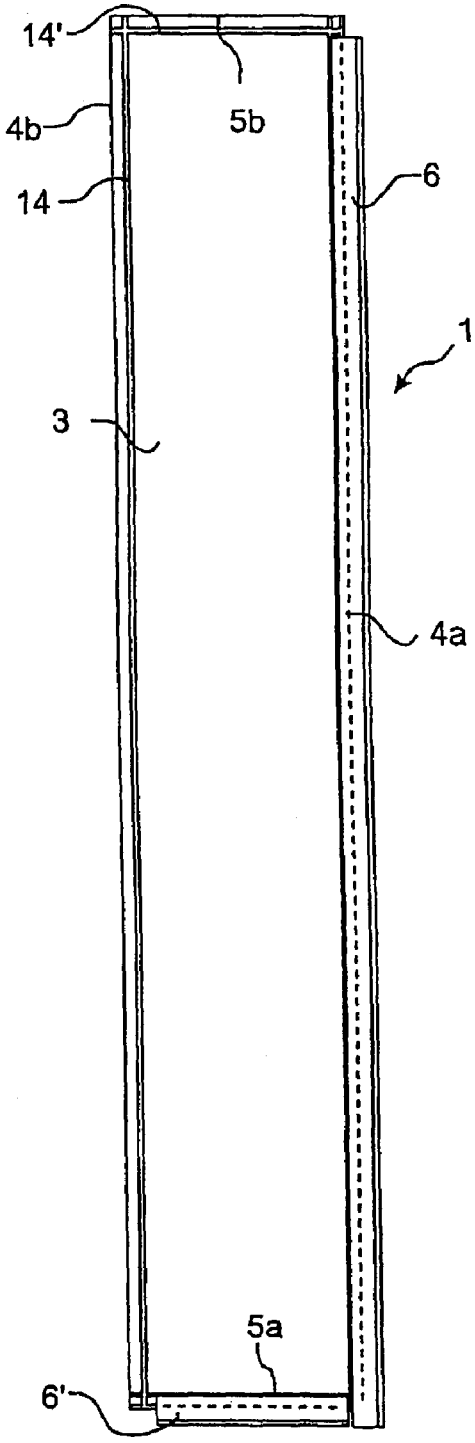
Figure 4A:
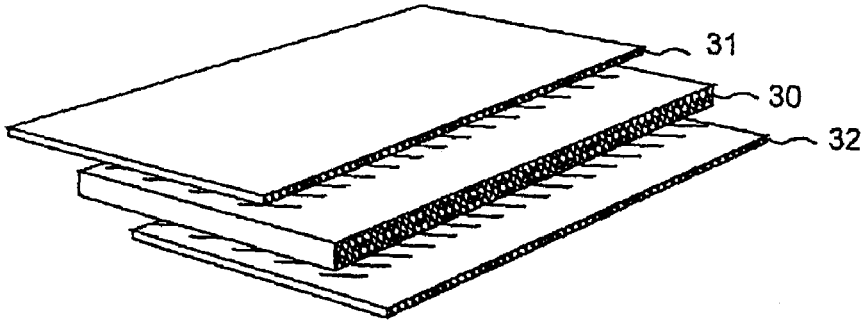
FIGS. 4*a–d* show conventional manufacture of laminate flooring.
Figure 4B:
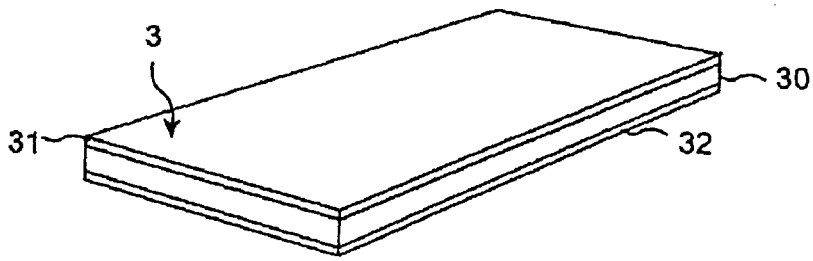
Figure 4C:
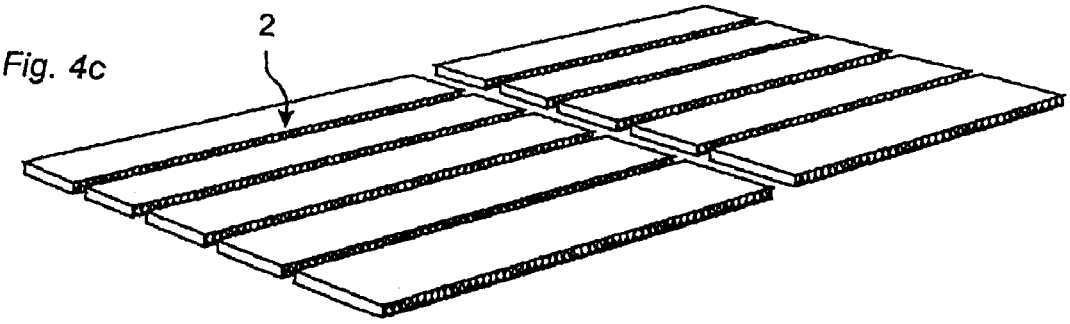
Figure 4D:
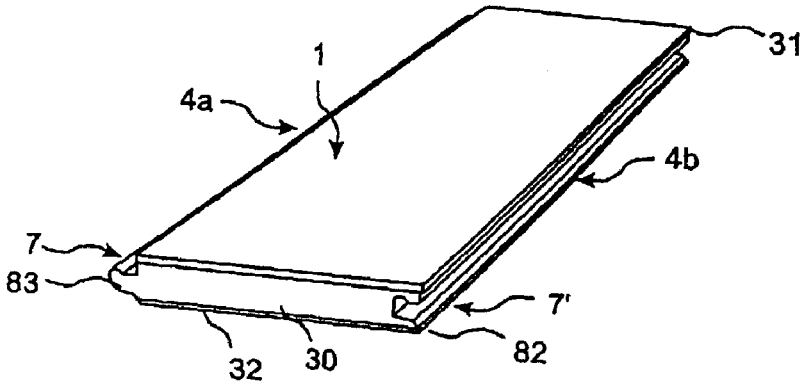
Figure 5A:
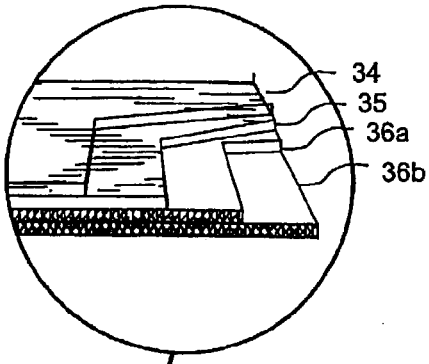
FIGS. 5*a–e* show manufacture of conventional laminate flooring.
Figure 5B:
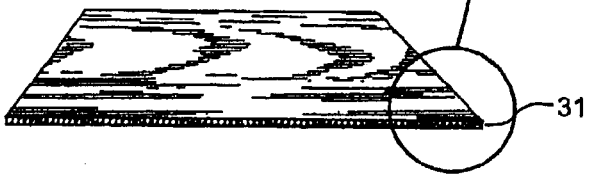
Figure 5C:
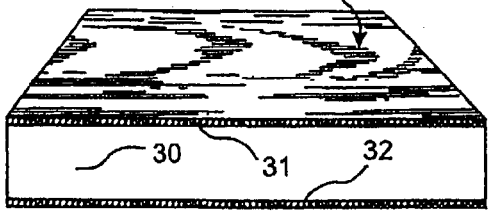
Figure 5D:
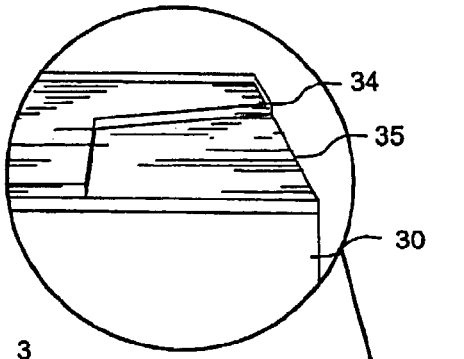
Figure 5E:
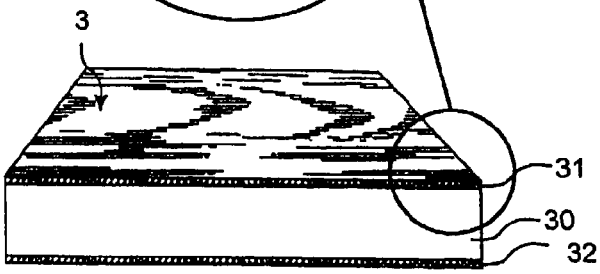
Figure 6A:
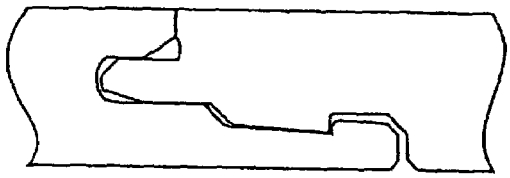
FIGS. 6*a–b* show a conventional mechanical locking system.
Figure 6B:
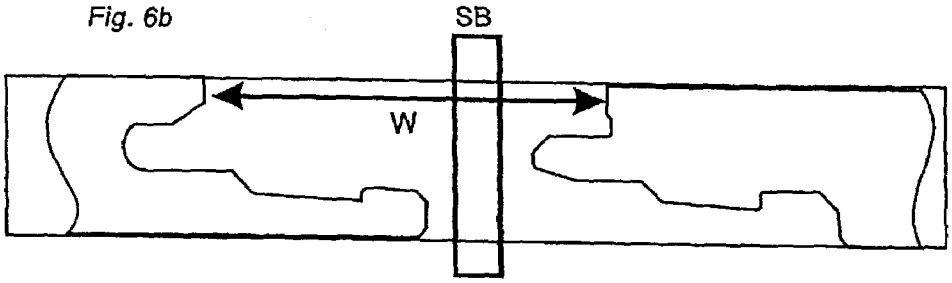
Figure 7A:
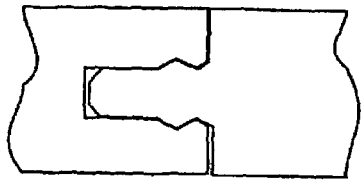
FIGS. 7*a–b* show another conventional mechanical locking system.
Figure 7B:
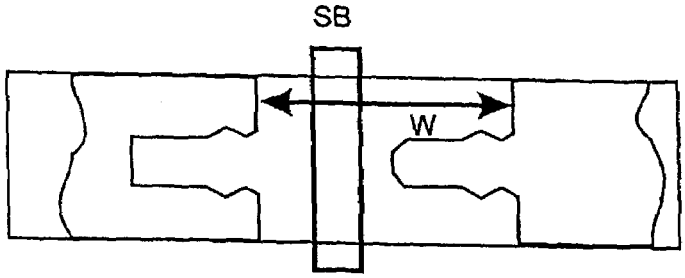
Figure 8A:
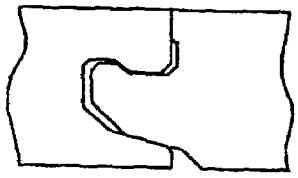
FIGS. 8*a–b* show a third conventional mechanical locking system.
Figure 8B:
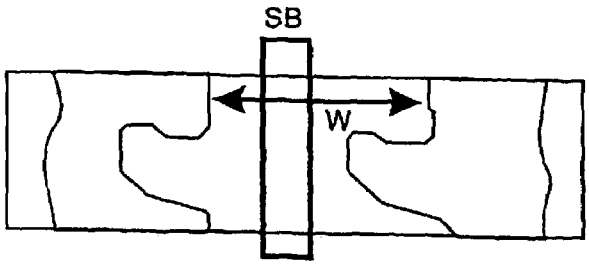
Figure 9A:
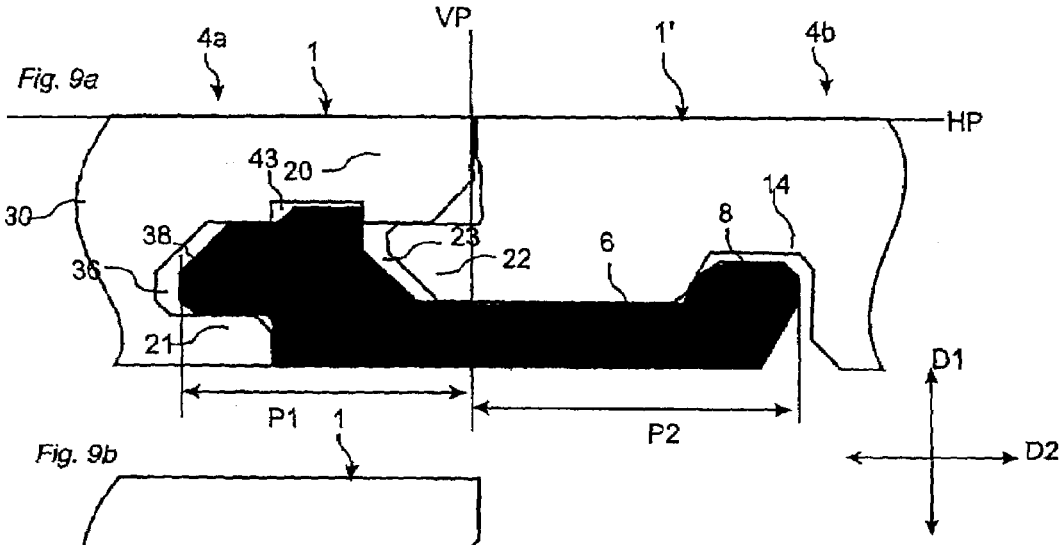
FIGS. 9*a–d* illustrate schematically an embodiment of the invention.
Figure 9B:
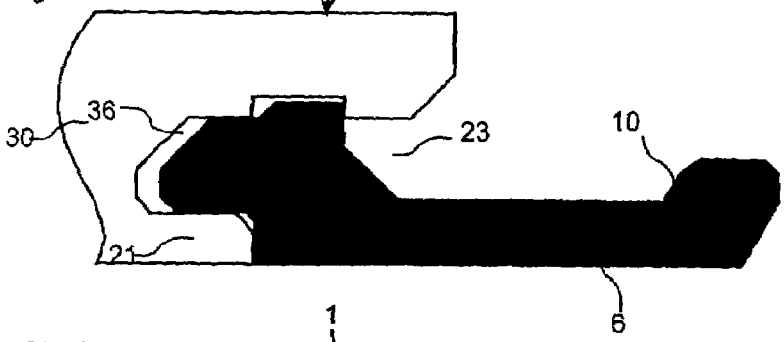

FIG. 9*a* illustrates schematically a cross-section through a joint between a long side edge portion 4*a* of a board 1 and an opposite long side edge portion 4*b* of a second board 1'.

The upper sides of the boards are essentially positioned in a common horizontal plane HP, and the upper parts of the joint edge portions 4*a*, 4*b* abut against each other in a vertical plane VP. The mechanical locking system provides locking of the boards relative to each other in the vertical direction D1 as well as the horizontal direction D2.

To provide joining of the two joint edge portions in the D1 and D2 directions, the edges of the floorboard include a tongue groove 23 in one edge portion 4*a* of the floorboard and a tongue 22 formed in the other joint edge portion 4*b* and projecting past the vertical plane VP.

In this embodiment, the board 1 has a body or core 30 of wood-fiber-based material.

The mechanical locking system according to the embodiment of the invention comprises a separate strip 6 which has a projecting portion P2 projecting past the vertical plane and having a locking element 8. The separate strip 6 also has an inner part P1 which is positioned inside the vertical plane VP and is mechanically joined with the floorboard 1. The locking element 8 coacts with a locking groove 14 in the other joint edge portion 4*b* and locks the floorboards relative to each other in the horizontal direction D2.

The floorboard 1 further includes a strip groove 36 in one joint edge portion 4*a* of the floorboard and a strip tongue 38 in the inner part P1 of the separate strip 6.

The strip groove 36 is defined by upper and lower lips 20, 21 and has the form of an undercut groove 43 with an opening between the two lips 20, 21.

Figure 9C:
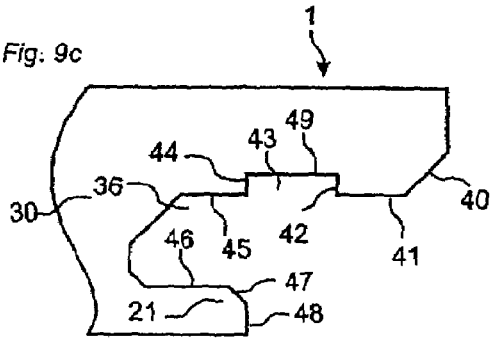

The different parts of the strip groove 36 are seen in FIG. 9*c*. The strip groove is formed in the body or core 30 and extends from the edge of the floorboard. Above the strip groove there is an upper edge portion or joint edge surface 40 which extends all the way up to the horizontal plane HP. Inside the opening of the strip groove there is an upper engaging or supporting surface 41, which in this embodiment is parallel to the horizontal plane HP. The engaging or supporting surface 41 transitions into a locking surface 42. Inside the locking surface there is a surface portion 49 forming the upper boundary of the undercut portion 33 of the strip groove and a surface 44 forming the bottom of the undercut groove. The strip groove further has a lower lip 21. On the upper side of this lip there is an engaging or supporting surface 46. The outer end of the lower lip has a lower joint edge surface 47 and a positioning surface 48. In this embodiment, the lower lip 21 does not extend all the way to the vertical plane VP.

Figure 9D:
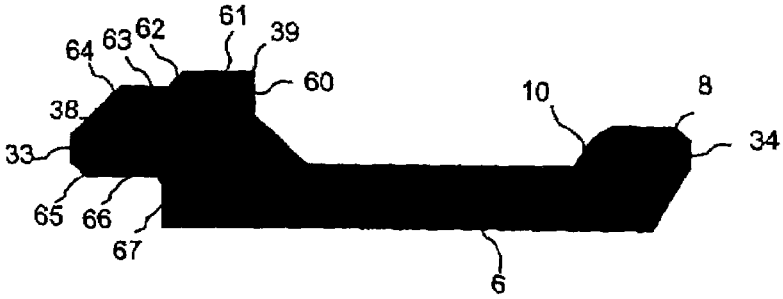

The shape of the strip tongue is also seen in FIG. 9*d*. In this preferred embodiment, the strip tongue is made of a wood-based board material, for instance HDF.

The strip tongue 38 of the separate strip 6 includes a strip locking element 39 which coacts with the undercut groove 43 and locks the strip to the joint edge portion 4*a* of the floorboard 1 in the horizontal direction D2. The strip tongue 38 is joined with the strip groove 36 by means of a mechanical snap joint. The strip locking element 39 has a strip locking surface 60 facing the vertical plane VP, an upper strip surface 61 and an inner upper guiding part 62, which in this embodiment is inclined. The strip tongue also has an upper engaging or supporting surface 63, which in this case extends all the way to an inclined upper strip tongue part 64 at the tip of the tongue. The strip tongue further has a lower guiding part 65, which in this embodiment passes into a lower engaging or supporting surface 66. The supporting surface passes into a lower positioning surface 67 facing the vertical plane VP. The upper and lower engaging surfaces 45, 63 and 46, 66 lock the strip in the vertical direction D1. The strip 6 is, in this embodiment, made of a board material containing wood fibers, for instance HDF.

Figure 10A:
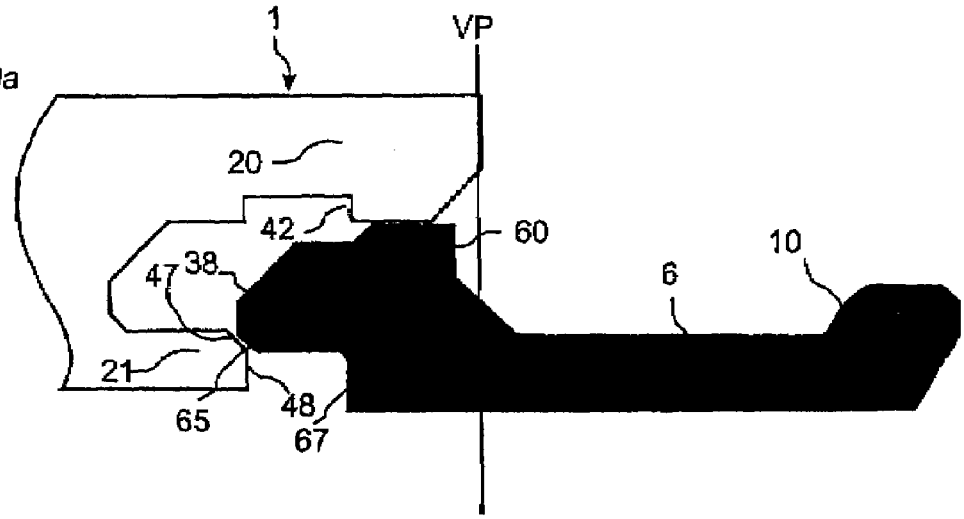
FIGS. 10*a–c* show schematically joining of a separate strip with a floorboard according to an embodiment of the invention.
Figure 10B:
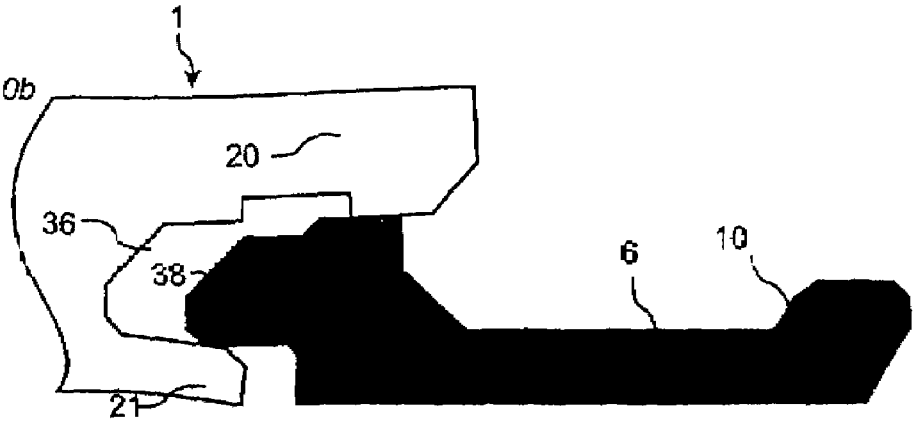
Figure 10C:
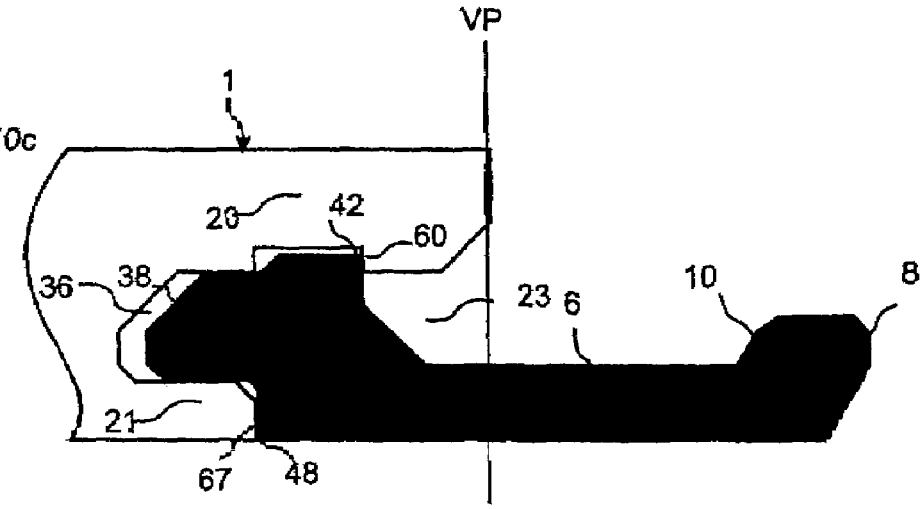

FIGS. 10*a–c* illustrate an embodiment of how the separate strip 6 is integrated with the floorboard 1 by snap action. When the floorboard 1 and the strip 6 are moved towards each other according to FIG. 10*a*, the lower guiding part 65 of the strip tongue will coact with the joint edge surface 47 of the lower lip 21. According to FIG. 10*b*, the strip groove 36 opens by the upper lip 20 being bent upwards and the lower lip 21 downwards. The strip 6 is moved until its positioning surface 67 abuts against the positioning surface 48 of the lower lip. The upper and the lower lips 20, 21 snap backwards and the locking surfaces 42, 60 lock the strip 6 into the floorboard 1 in the horizontal direction. The strip tongue 38 and the strip groove 36 lock in the vertical direction D1. The locking element 8 and its locking surface 10, by snap motion, are exactly positioned relative to the upper joint edge of the floorboard and the vertical plane VP. Thus, by this snap motion the floorboard has been integrated with a machined strip which, in this embodiment, is made of a separate sheet-shaped and wood-fiber-based material.

Figures 11A, 11B, 11C, 12A, 12B, 12C, 13:
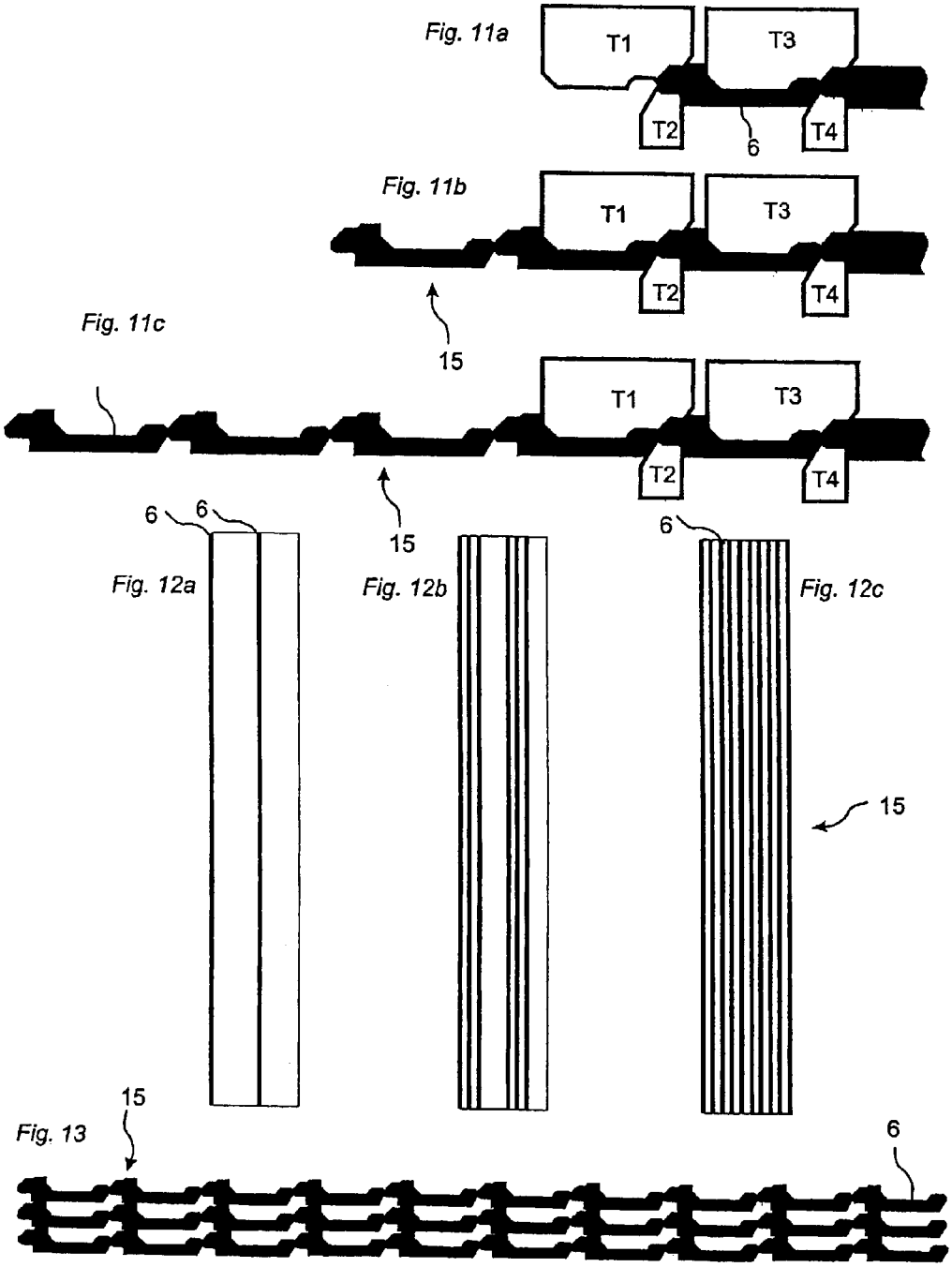
FIGS. 11*a–c* illustrate machining of strip blanks according to an embodiment of the invention.
FIGS. 12*a–c* show how a strip blank is made in a number of manufacturing steps according to an embodiment of the invention.
FIG. 13 shows how a plurality of strip blanks can be handled according to an embodiment of the invention.
Figure 14A:
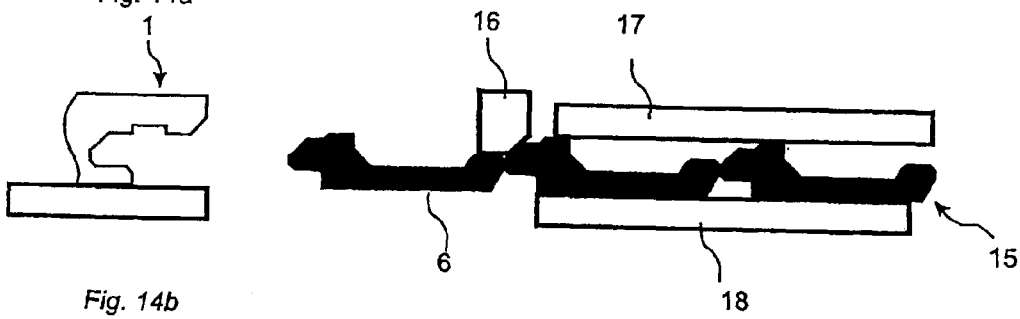
FIGS. 14*a–d* show how the separate strip is joined with the floorboard and separated from the strip blank according to an embodiment of the invention.
Figure 14B:
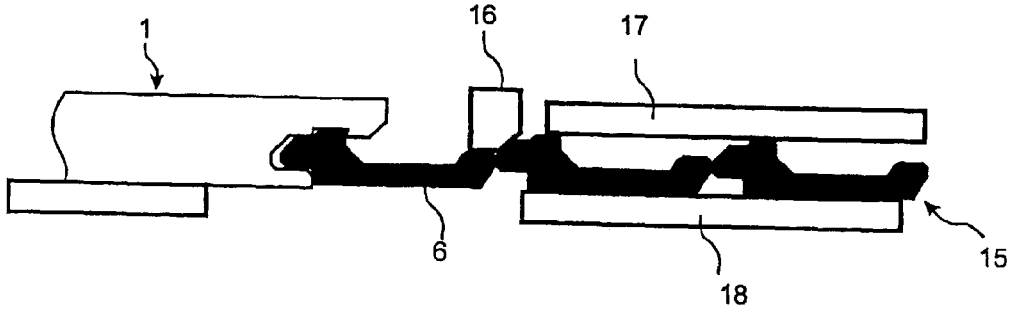
Figure 14C:
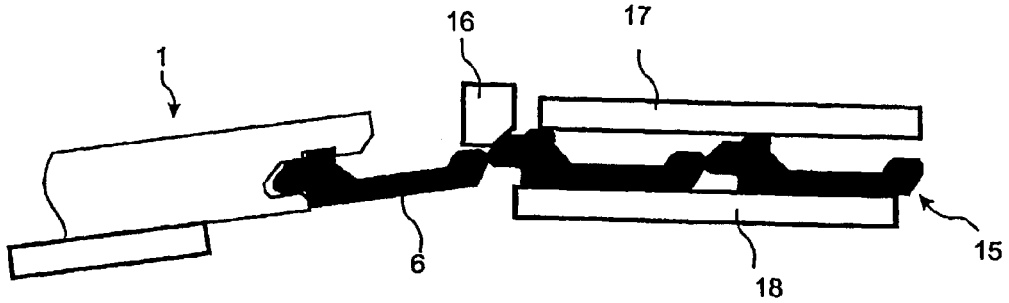
Figure 14D:
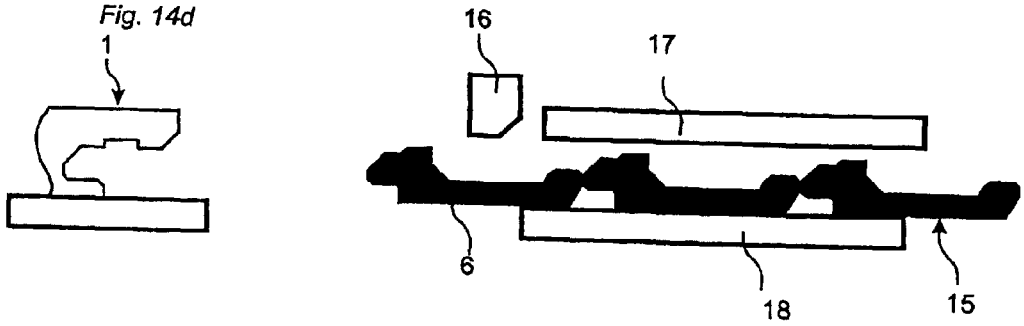

FIGS. 11*a–c* show an embodiment of how a strip blank 15 comprising a plurality of strips 6 is made by machining. T1–T4 indicate machining tools, preferably of diamond type, operating from above and from below. Only two tools T1 and T2 are used to produce a strip 6. In the first manufacturing step according to FIG. 11*a*, a strip 6 is made. However, this strip is not separated from the strip blank. In the next machining, the strip blank 15 is moved sideways a distance corresponding to the width of two strips. In the third manufacturing step, this step is repeated and now two more strips are manufactured. The strip blank thus grows by two strips in each run through the machine.

FIGS. 12*a–c* show an embodiment of how the strip blank 15 with a plurality of strips 6 can be manufactured in a double-sided milling machine with four tools on each side. In the first manufacturing step according to FIG. 12*a*, two strips are manufactured. In the next manufacturing step, FIG. 12*b*, four more strips are manufactured. FIG. 12*c* shows that the strip blank includes 10 strips after three steps. With a double-sided machine, which has, for instance, 8 milling motors and 8 tools on each side, 8 strips can be made in each run through the milling machine. Since machining can take place in, e.g., HDF which does not have a surface layer, machining speeds of up to 200 m/min can be achieved with 8 strips in each run. Since normal flooring lines machine the joint edges by about 100 m/min, such a line can provide 16 flooring lines with strip blanks. The strips are made of a board material which can be considerably thinner than the floorboard. The cost of a separate strip with a width of 15–20 mm, made of an HDF board having a thickness of, for instance, 5 mm, is less than 30% of the waste cost in machining an 8 mm laminate floorboard with an integrated strip which has an extent outside the joint edge corresponding to about 8–10 mm.

A feature according to an embodiment of the present invention is that the separate strip is made by machining a sheet-shaped material.

FIG. 13 shows an embodiment of a plurality of strip blanks which can be stacked and handled efficiently.

FIGS. 14*a–d* show an embodiment of a manufacturing method for integrating the strip with the floorboard. The strip blank 15 is fed between upper and lower supports 17, 18 towards a stop member 16 so that the strip 6 will be correctly positioned. The floorboard 1 is moved towards the strip according to FIG. 14*b* so that snapping-in takes place. Then the strip 6 is separated from the strip blank 15, for instance, by the strip being broken off. Subsequently this manufacturing step is repeated according to FIG. 14*b*. The equipment required for this snapping-in is relatively simple, and manufacturing speeds corresponding to normal flooring lines can be obtained. The strip 6 can in this manner be joined by snapping both to a long side and to a short side. It is obvious that a number of variants of this manufacturing method are feasible. The strip 6 can be moved towards the floorboard. The strip can be separated in a number of other ways, for instance, by cutting off, sawing, etc., and this can also take place before fastening.

FIGS. 15*a–d* show an embodiment of a production-adjusted variant of the invention. In this embodiment, the upper and lower lips 20, 21 of the strip groove 36 as well as the upper and lower engaging surfaces 63, 66 of the strip tongue are inclined relative to the horizontal plane HP and they follow lines L1 and L2. Such an embodiment can significantly facilitate snapping the strip into the floorboard 1. The lower lip 21 has been made longer and the locking groove of the strip and the locking surface of the undercut groove are inclined. This facilitates manufacture and snapping-in. In this embodiment, the positioning of the strip in connection with snapping-in takes place by part of the upper guiding part 62 coacting with the bottom 44 of the undercut groove. The locking element 8 has a locking surface 10 which has the same inclination as the tangent TC to the circular arc with its center in the upper joint edge. Such an embodiment can facilitate inward angling but preferably the projecting portion P2 should have an extent which is the same size as the thickness T of the floorboard for the locking surface of the locking element to have a sufficiently high angle relative to the underside of the board. A high locking angle increases the locking capability of the locking system. The separate strip allows joint geometries with an extended projecting portion P2 without this causing greater costs in manufacture. An extended inner part P1 facilitates integration by snap action and results in high fastening capability. The following ratios have been found particularly favorable: $P2 \geqq T$ and $P1 \geqq 0.5T$.

Figure 15A:
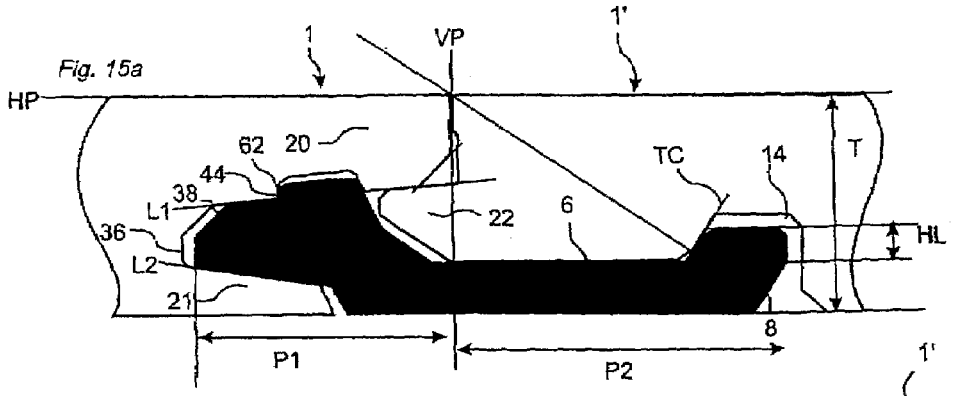
Figure 15B:
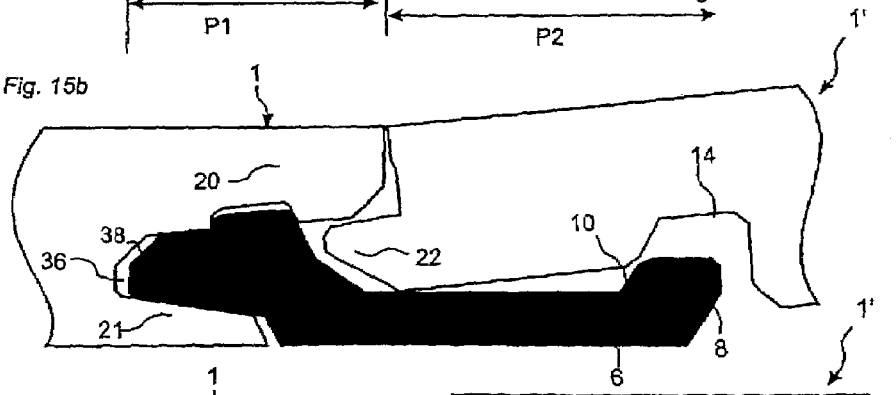
Figure 15C:
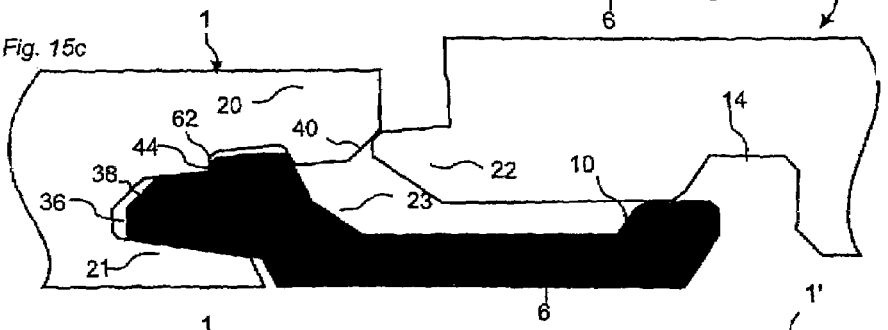

FIG. 15*b* shows an embodiment of inward angling with a play between the locking element 8 and the locking groove 14 during the initial phase of the inward angling when the upper joint edges touch each other and when parts of the lower part of the locking groove 14 are lower than the upper part of the locking element 8.

Figure 15D:
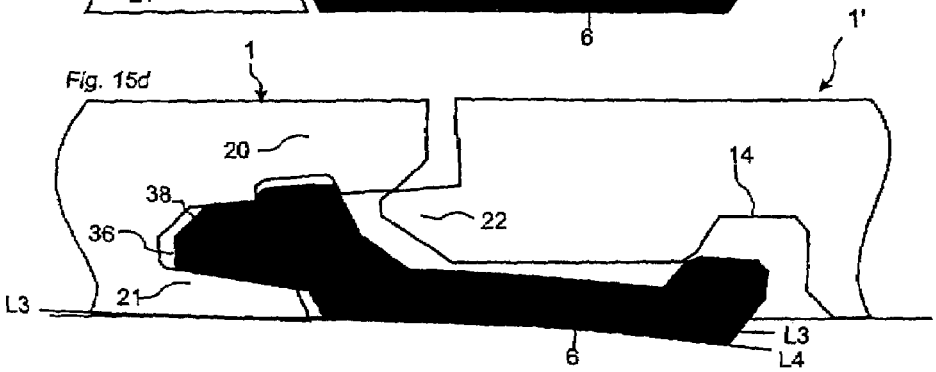
Figure 16A:
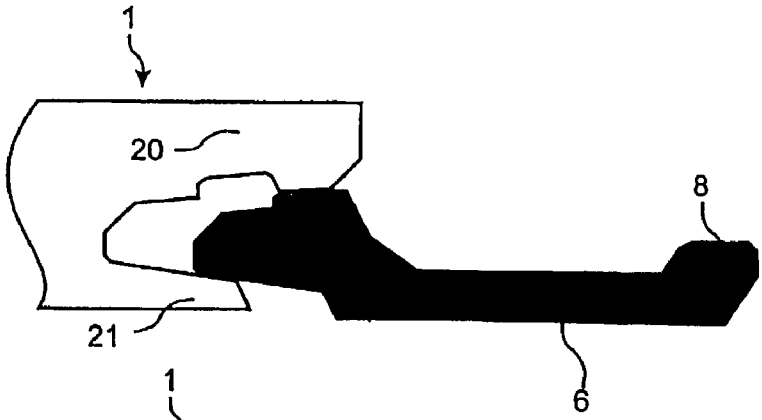
FIGS. 16*a–d* show joining of a production-adjusted separate strip blank with the floorboard by snap action according to the invention.
Figure 16B:
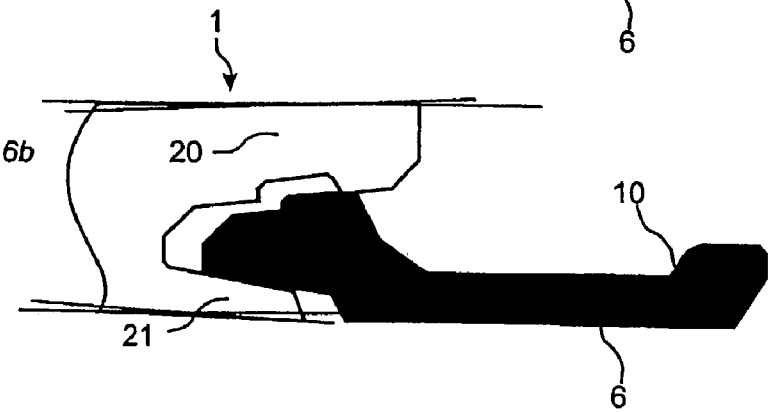
Figure 16C:
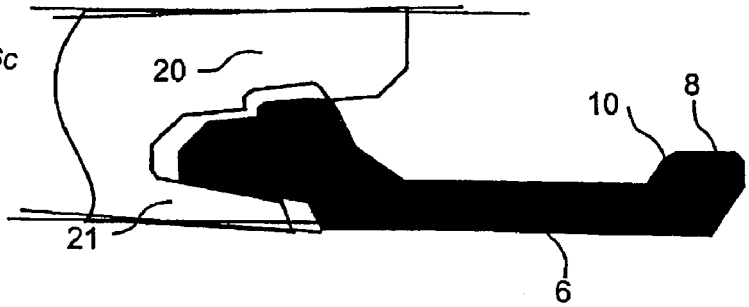
Figure 16D:
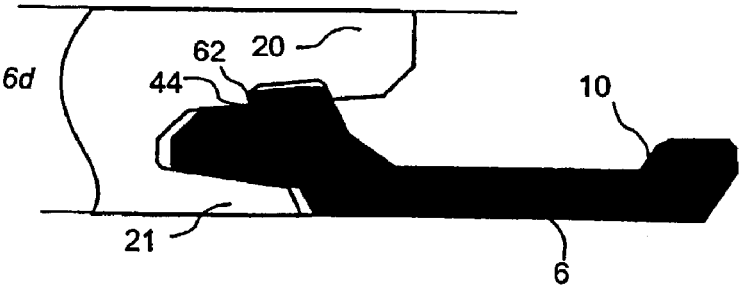

FIG. 15*d* shows an embodiment of snapping-in of the floorboard 1' into the floorboard 1. A separate strip 6, which is mechanically integrated with the floorboard 1, facilitates snapping-in by the strip 6 being able to move in a rotary motion in the strip groove 36. The strip can then turn as indicated by line L3. The remaining displacement downwards of the locking element 8 to the position L4 can be effected by downward bending of the strip 6. This makes it possible to provide locking systems which are capable of snapping and angling on a long side as well as on a short side and which have a relatively high locking element 8. In this way, great strength and good capability of inward angling can be combined with the snap function and a low cost. The following ratio has been found favorable: HL≧0.15 T. This can also be combined with the above ratios.

FIGS. 16*a–d* show an embodiment of snapping-in of the strip 6 in four steps. As shown in the figures, the inclined surfaces allow the snapping-in of the strip 6 into the floorboard 1 to be made with a relatively small bending of the upper and lower lips 20 and 21.

Figure 17:
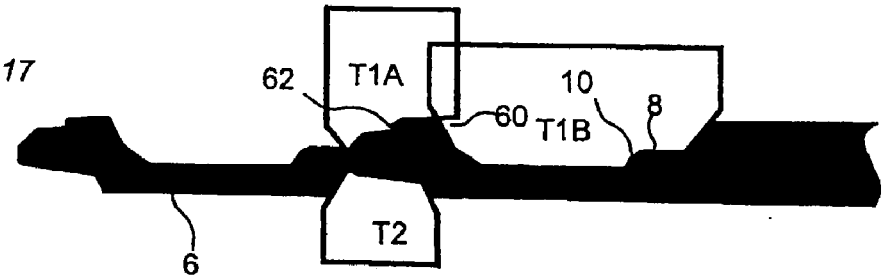
FIG. 17 illustrates a preferred alternative of how the separate strip is made by machining according to an embodiment of the invention.
Figure 18A:
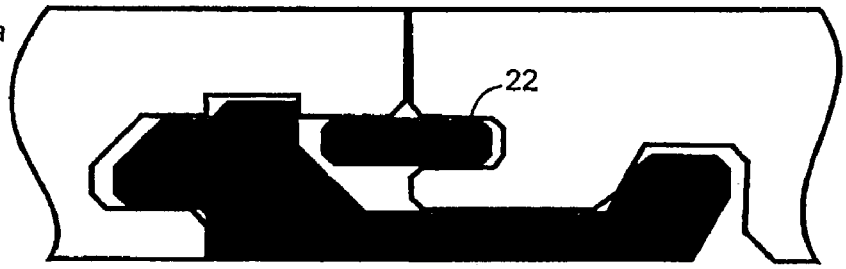
FIGS. 18*a–d* illustrate a preferred embodiment according to an embodiment of the invention with a separate strip and tongue.
Figure 18B:
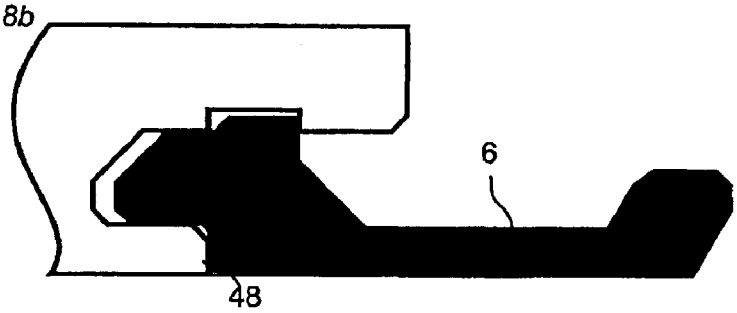
Figure 18C:
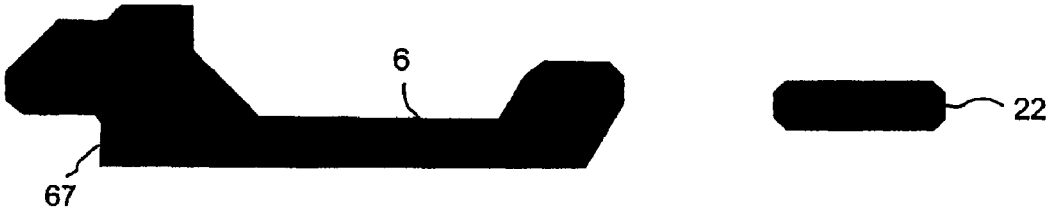
Figure 18D:
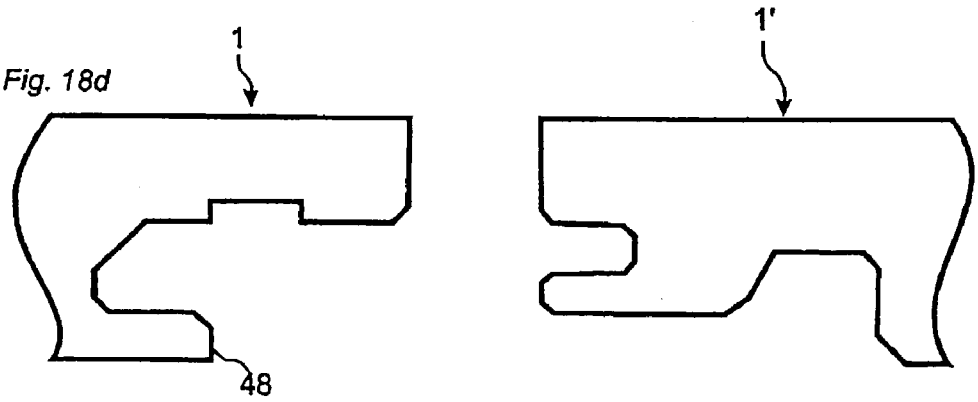
Figure 19A:
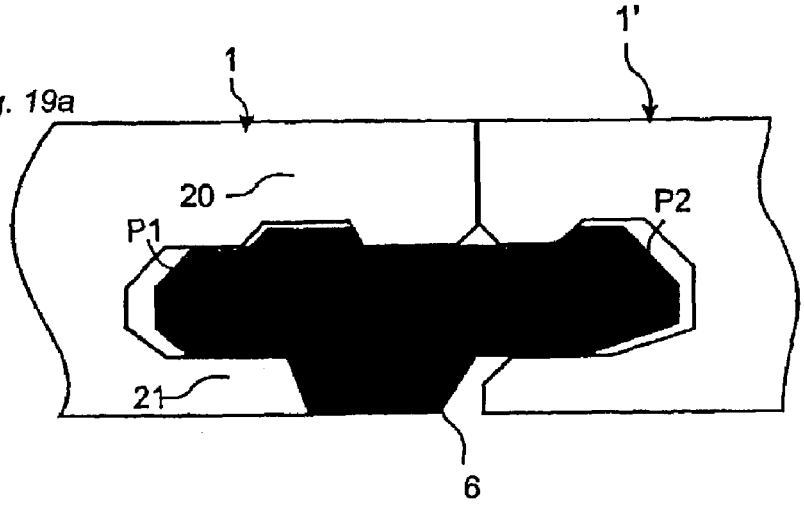
FIGS. 19*a–d* illustrate a preferred embodiment according to the invention.
Figure 19B:
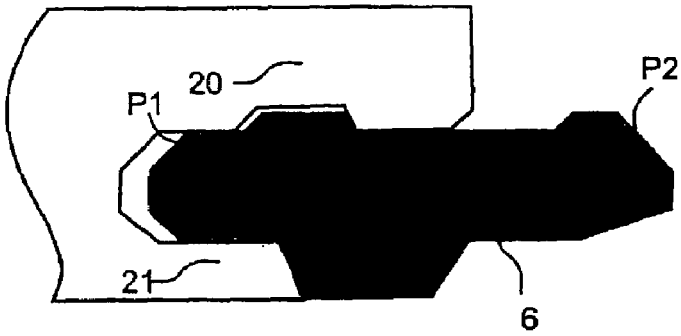
Figure 19C:
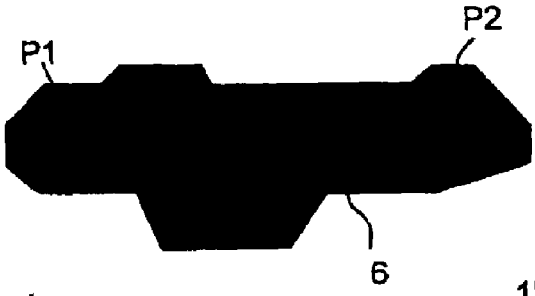
Figure 19D:
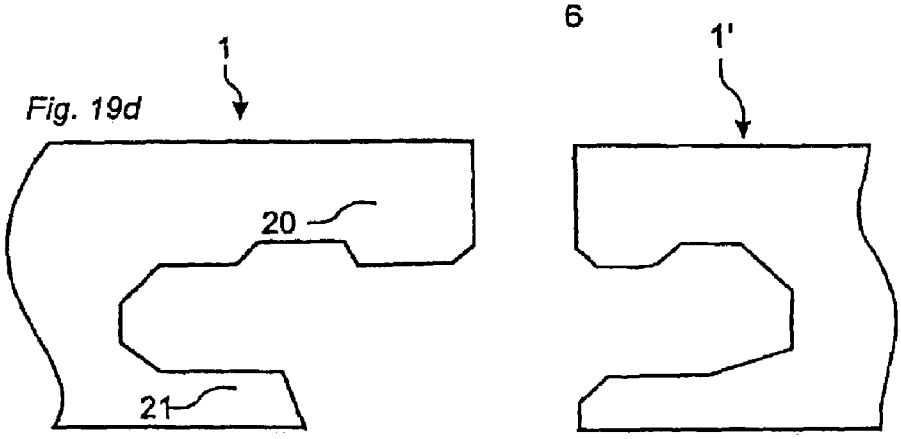
Figure 20A:
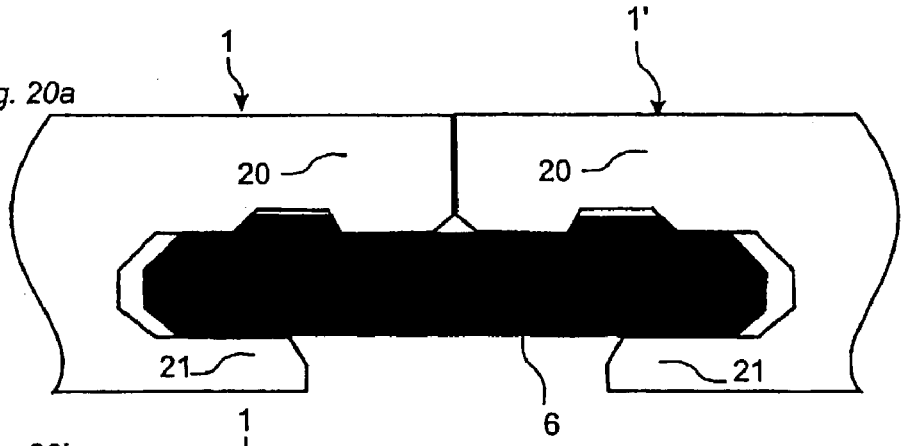
FIGS. 20*a–e* illustrate a preferred embodiment according to the invention with a separate strip having symmetric edge portions.
Figure 20B:
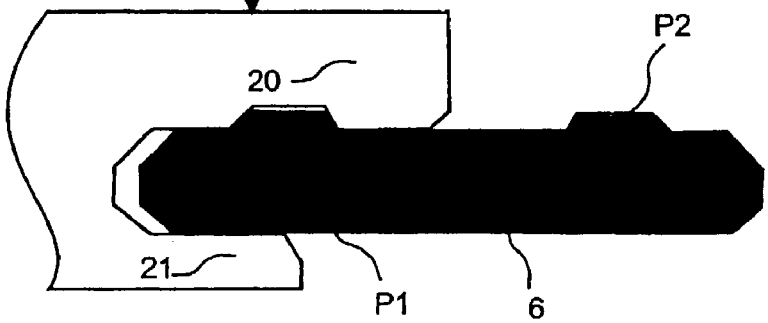
Figure 20C:
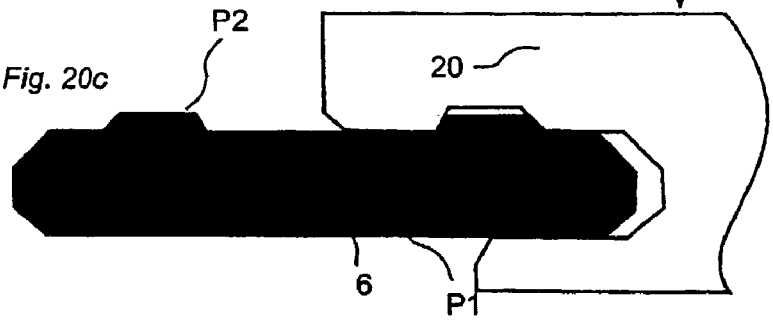
Figure 20D:
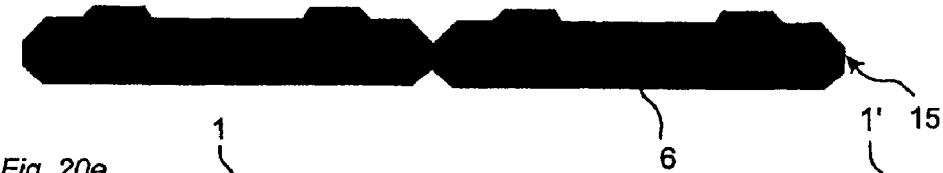
Figure 20E:
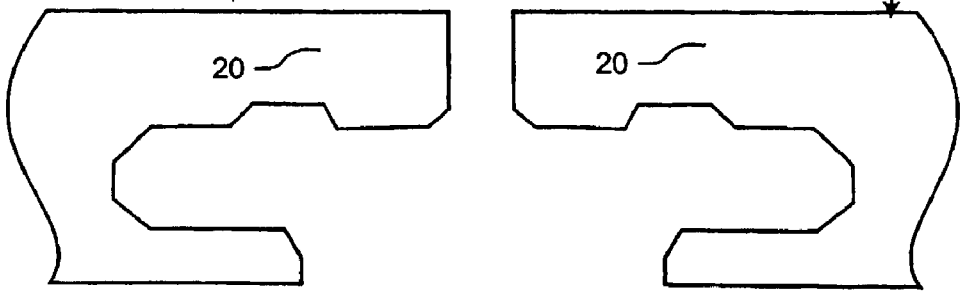

FIG. 17 shows an embodiment of manufacturing of a strip blank where all three locking and positioning surfaces are made using a divided tool which contains two adjustable tool parts T1A and T1B. These tool parts are fixed in the same tool holder and driven by the same milling motor. This divided tool can be ground and set with great accuracy and allows manufacture of the locking surfaces 10 and 60 as well as the positioning surface 62 with a tolerance of a few hundredths of a millimeter. The movement of the board between different milling motors and between different manufacturing steps thus does not result in extra tolerances.

FIGS. 18*a–d* show an embodiment of the invention where also the tongue 22 is made of a separate material. This embodiment can reduce the waste still more. Since the tongue locks only vertically, no horizontal locking system other than friction fastens the tongue in the floorboard 1'.

FIGS. 19*a–d* show another embodiment of the invention in which the projecting portion P2 has a locking element which locks in an undercut groove in the board 1'. Such a locking system can be locked by angling and snapping and it can be unlocked by upward angling about the upper joint edge. Since the floorboard 1' has no tongue, the amount of wasted material can be minimized.

FIGS. 20*a–e* show an embodiment of the invention which is characterized in that the separate strip 6 includes two symmetric parts, and that the joint portions of the floorboards 1, 1' are symmetrically identical. This embodiment allows simple manufacture of, for instance, boards which may include A and B boards which have mirror-inverted locking systems. The locking system of the preferred geometry is not openable. An openable geometry can be achieved, for instance, by rounding of the lower and outer parts of the strip 6.

Figures 21, 22, 23, 24, 25, 26:
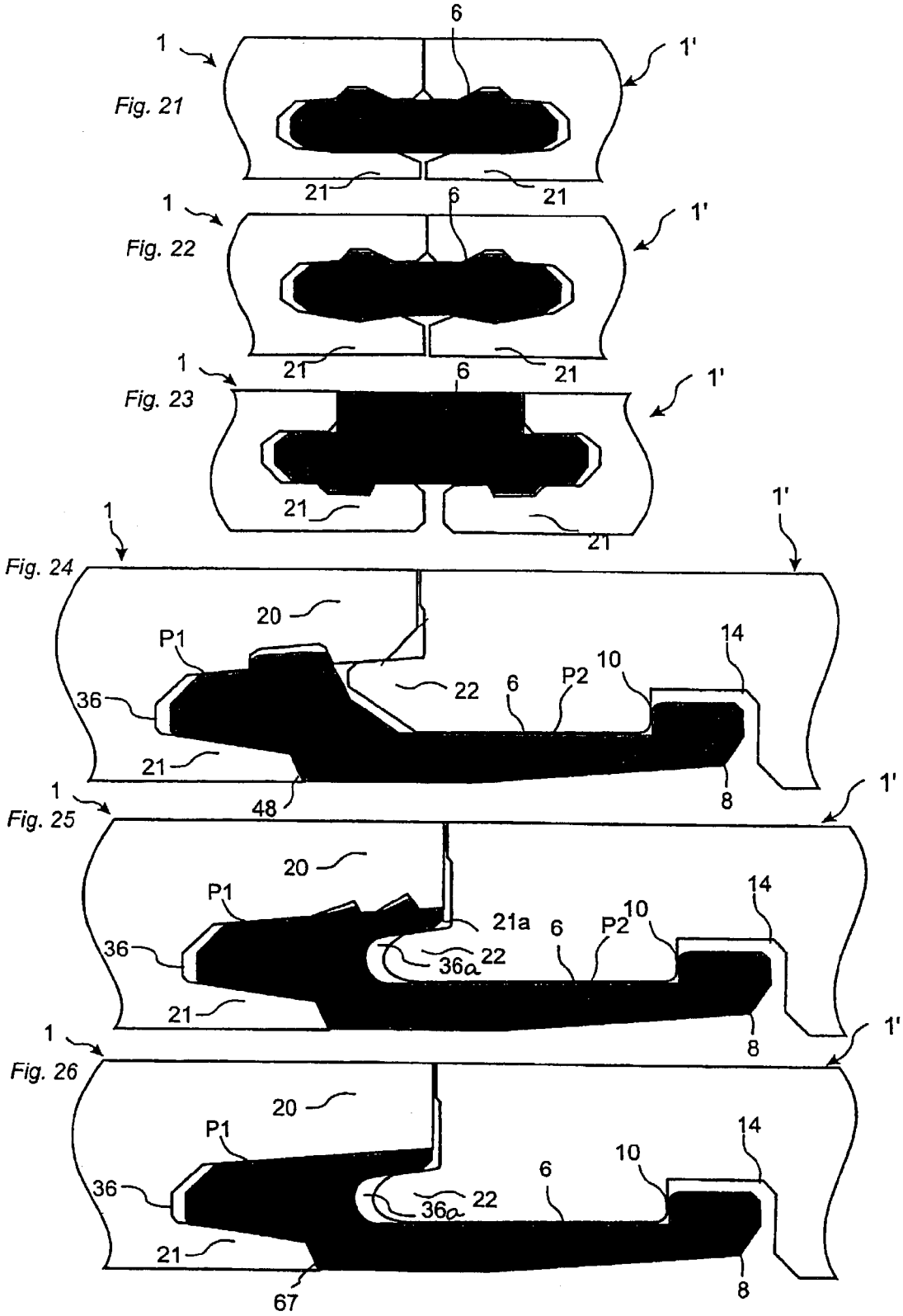
FIGS. 21–26 show examples of different embodiments according to the invention.

FIGS. 21–26 illustrate embodiments of variants of the invention. FIG. 21 shows an embodiment with lower lips 21 which extend essentially to the vertical plane.

FIG. 22 shows an embodiment with locking elements on the upper and lower sides of the strip 6.

FIG. 23 shows an embodiment with a separate strip which is visible from the surface and which may constitute a decorative joint portion.

FIG. 24 shows an embodiment with a separate strip with a tapering projecting portion which improves the flexibility of the strip.

FIG. 25 shows an embodiment where the inner portion P1 of the strip 6 has a tongue groove 36*a*. This may facilitate snapping-in of the strip since also the tongue groove 36*a* is resilient by its lip 21*a* also being resilient. The tongue groove can be made by means of an inclined tool according to conventional techniques. In this embodiment, the inner portion P1 has two locking elements.

FIG. 26 shows an embodiment where the inner portion P1 has no locking element. The strip 6 is inserted into the strip groove 36 until it abuts against the lower positioning surface and is retained in this position by frictional forces. Such an embodiment can be combined with gluing which is activated in a suitable manner by heating, ultrasound, etc. The strip 6 can be preglued before being inserted.

Figure 27A:
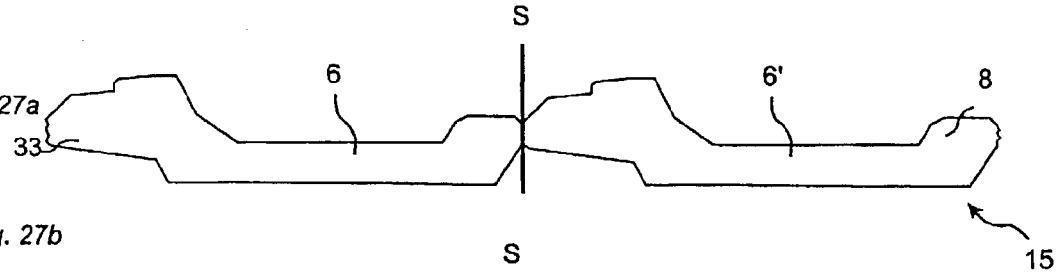
FIGS. 27*a–b* show examples of how the separate strip according to an embodiment of the invention can be separated from the strip blank.
Figure 27B:
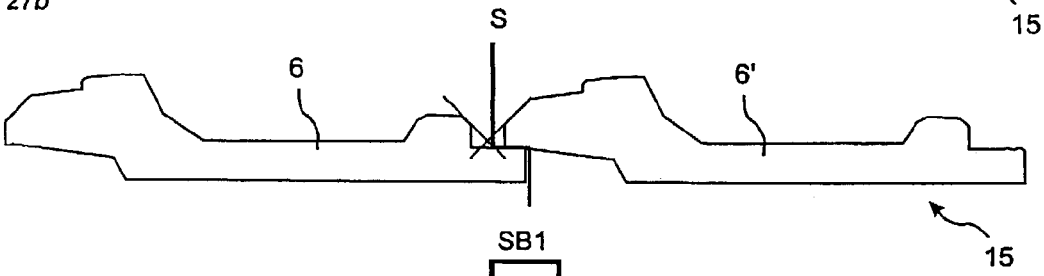

FIGS. 27*a* and *b* show two embodiments of variants which facilitate separation by the strip 6 being separated from the strip 6' by being broken off. In FIG. 27*a*, the strip 6 is designed so that the outer part of the strip tongue 33 is positioned on the same level as the rear part of the locking element 8. Breaking-off takes place along line S. FIG. 27*b* shows another variant which is convenient, especially in HDF material and other similar materials where the fibers are oriented essentially horizontally and where the fracture surface is essentially parallel to the horizontal plane HP. Breaking-off takes place along line S with an essentially horizontal fracture surface.

Figure 28A:
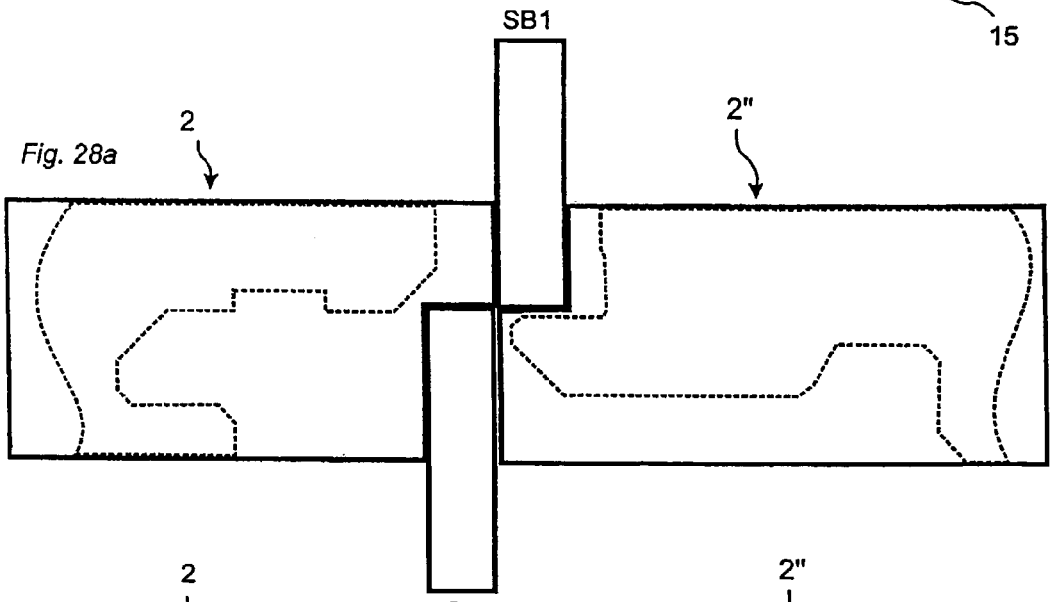
FIGS. 28*a–b* show how sawing of floor elements into floor panels can take place according to an embodiment of the invention so as to minimize the amount of wasted material.
Figure 28B:
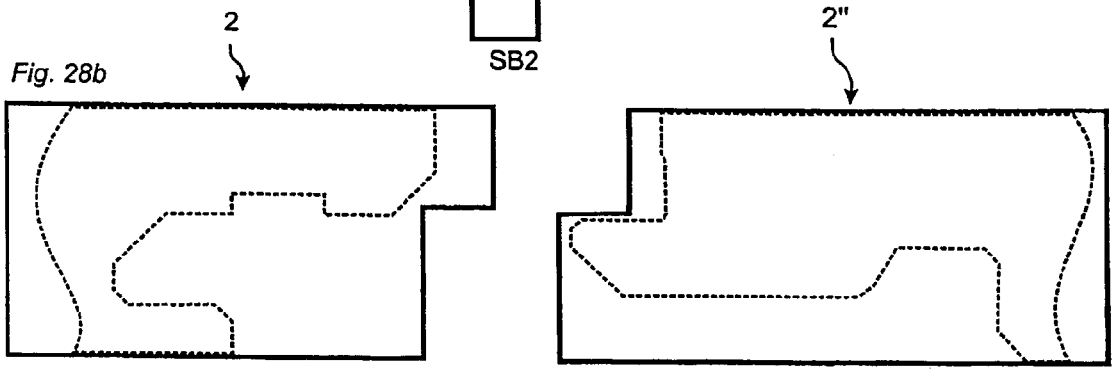

FIGS. 28*a* and *b* show embodiments of the invention where the amount of wasted material can be minimized by the joint edge formed with a tongue. Sawing can take place with an upper sawblade SB1 and a lower sawblade SB2 which are laterally offset. The floor elements 2 and 2' will only have an oversize as required for efficient machining of the joint edges without taking the shape of the tongue into consideration. By such an embodiment, the amount of wasted material can be reduced to a minimum.

Figure 29A:
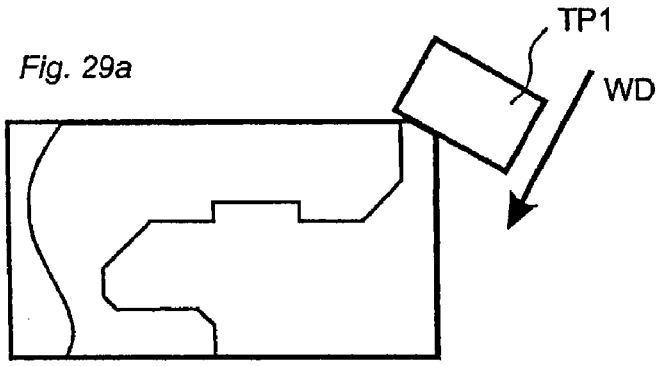
FIGS. 29*a–e* show machining of joint edge portions according to an embodiment of the invention.
Figure 29B:
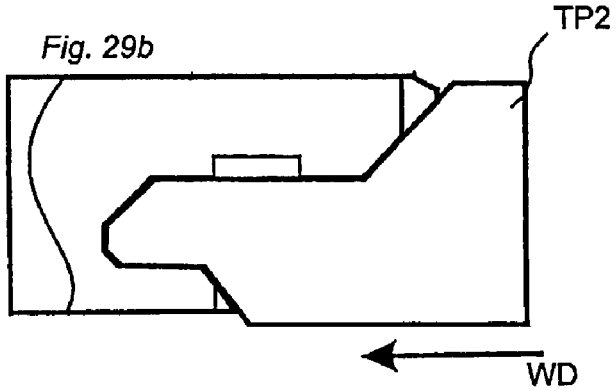
Figure 29C:
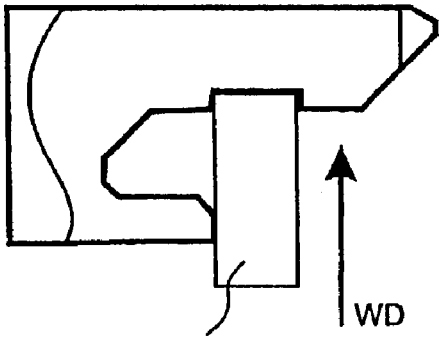
Figure 29E:
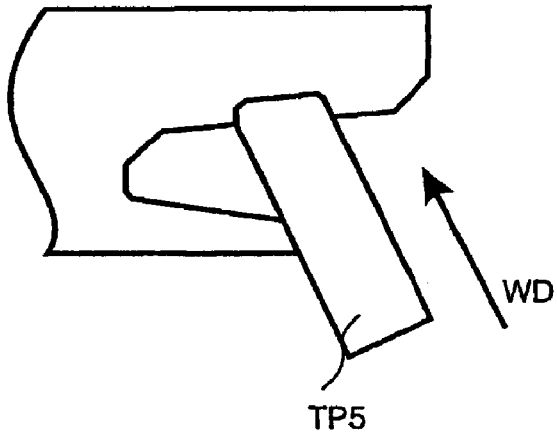
Figure 29D:
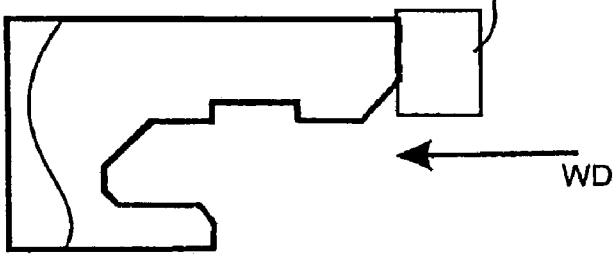

FIGS. 29*a–e* show embodiments of machining of joint edge portions using diamond cutting tools. A tool TP1 with engaging direction WD machines the laminate surface in a conventional manner and performs premilling. A minimum part of the laminate surface is removed. According to FIG. 29*b*, the strip groove is made and the tool TP2 operates merely in the core material and the rear side. FIG. 29*c* shows how the undercut groove with the locking surface and an upper and a lower positioning surface are formed with a tool TP3. All surfaces for the horizontal positioning and locking of the strip can thus be formed with great accuracy using one and the same tool. FIG. 29*e* shows how the corresponding machining can be carried out using an inclined tool TP5. Finally the upper joint edge is machined by means of the tool TP4. The joint geometry and the manufacturing methods according to the invention thus make it possible to manufacture floorboards with advanced locking systems. At the same time machining of the joint edges can be carried out using fewer tools than normal, with great accuracy and with a minimum amount of wasted material. Wooden flooring does not require a premilling tool TP1 and machining may therefore take place using three tools only.

Figure 30:
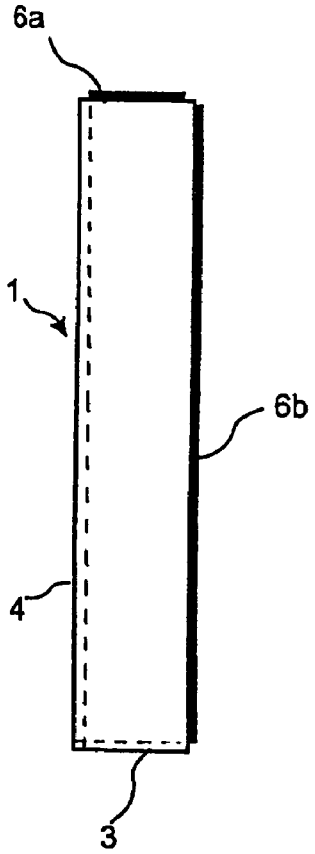
FIG. 30 shows a format corresponding to a normal laminate floorboard with a separate strip on long side and short side according to an embodiment of the invention.
Figure 31:
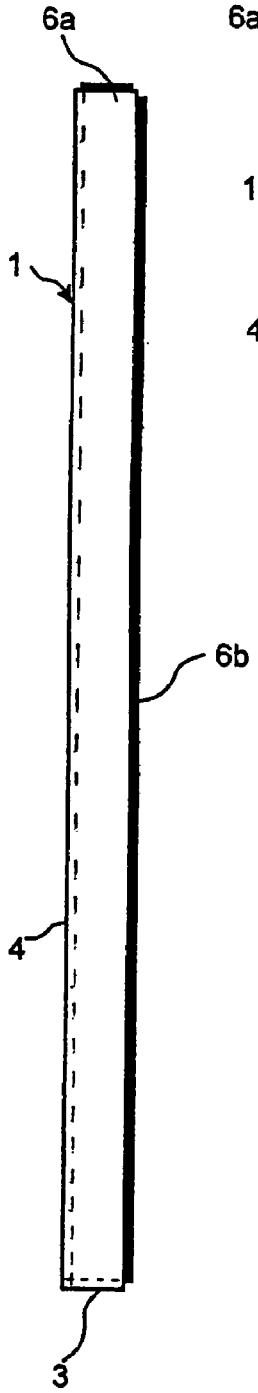
FIG. 31 shows a long and narrow floorboard with a separate strip on a long side and a short side according to an embodiment of the invention.

FIG. 30 illustrates a laminate floorboard with strips 6*b* and 6*a* according to an embodiment of the invention on a long side 4 and a short side 3. The strips can be of the same material and have the same geometry but they may also be different. Embodiments of the invention give great possibilities of optimizing the locking systems on the long side and the short side as regards function, cost, and strength. On the short sides, where the strength requirements are high and where snapping-in is important, advanced, strong, and resilient materials such as compact laminate can be used. In long and narrow formats, the long side contains essentially more joint material, and therefore it has been useful in conventional locking systems to reduce the extent of the strip outside the joint edge as much as possible. This has made snapping-in difficult or impossible, which is an advantage in certain laying steps where inward angling cannot take place. These limitations are largely eliminated by the present invention. FIG. 31 shows a long and narrow floorboard which necessitates a strong locking system on the short side. The saving in material that can be made using the present invention in such a floorboard is considerable.

Figure 32A:
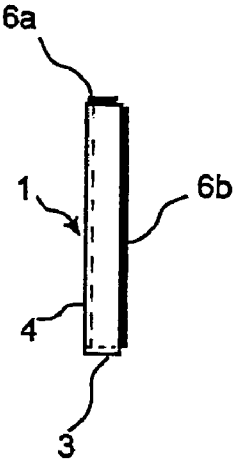
FIGS. 32*a–b* show formats corresponding to a parquet block in two mirror-inverted embodiments with a separate strip on a long side and a short side according to an embodiment of the invention.
Figure 32B:
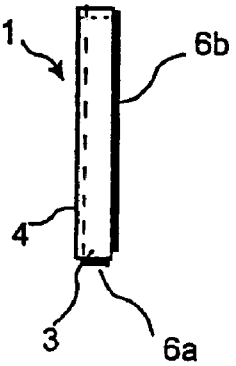

FIGS. 32*a–b* show formats resembling parquet blocks. A mechanical locking system of a traditional type can in such a format, for instance 70*400 mm, cause an amount of wasted material of more than 15%. Such formats are not available on the market as laminates. According to an embodiment of the present invention, these formats can be manufactured efficiently with a mechanical locking system which is less expensive than also traditional systems using tongue, groove and glue. They can also, as shown in these two figures, be manufactured with a mirror-inverted system where the strip on the short side is alternately snapped into the upper and lower short sides.

Figure 33:
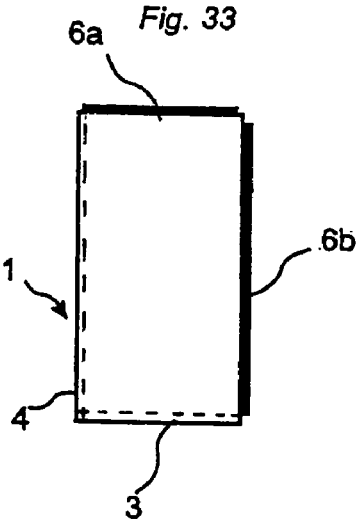
FIG. 33 shows a format which is suitable for imitating stones and tiles with a separate strip on a long side and a short side according to an embodiment of the invention.

FIG. 33 shows a format with a wide short side. Such a format is difficult to snap in since downward bending of the long strip 6*a* on the short side means that a great bending resistance is overcome. According to an embodiment of the present invention, this problem is solved by the possibility of using flexible materials in the separate strip which also according to the description above can be made partially turnable in the inner portion.

It is obvious that a large number of variants of preferred embodiments are conceivable. First, the different embodiments and descriptions can be combined wholly or partly. The inventor has also tested a number of alternatives where geometries and surfaces with different angles, radii, vertical and horizontal extents and the like have been manufactured. Beveling and rounding-off can result in a relatively similar function. A plurality of other joint surfaces can be used as positioning surfaces. The thickness of the strip may be varied and it is possible to machine materials and make strips of board materials that are thinner than 2 mm. A large number of known board materials, which can be machined and are normally used in the floor, building and furniture industries, have been tested and found usable in various applications of the invention. Since the strip is integrated mechanically, there are no limitations as may be the case when materials are joined with each other by means of gluing.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A locking system for a floorboard comprising:

connectors integrated with the floorboard and adapted to connect the floorboard with an essentially identical floorboard, wherein upper joint edges of said floorboard and said essentially identical floorboard in a connected state define a vertical plane, said connectors designed to connect said floorboard with said essentially identical floorboard in at least a horizontal direction perpendicular to said vertical plane, said connectors comprising a locking strip which projects from said vertical plane and carries a locking element which is designed to cooperate, in said connected state, with a downward open locking groove of said essentially identical floorboard, said locking strip is a separate part which is mechanically fixed to the floorboard in said horizontal direction and a vertical direction, said locking strip designed for connecting the floorboard with the essentially identical floorboard by at least inward angling of the floorboard relative to the essentially identical floorboard, wherein the locking strip substantially consists of a machined sheet-shaped material and is made essentially of a wood-based material.

2. The locking system for a floorboard as claimed in claim 1, wherein said wood-based material is selected from the group consisting of pure wood, particle board, plywood, HDF, MDF and compact laminate.

3. The locking system for a floorboard as claimed in claim 2, comprising a strip groove in the floorboard to receive said locking strip and a tongue groove in the floorboard to receive a tongue arranged on said essentially identical floorboard, wherein said tongue groove and tongue form a connection in a vertical direction perpendicular to a principal plane of the floorboard and wherein at least one surface of said tongue groove consists of said locking strip.

4. The locking system for a floorboard as claimed in claim 3, wherein the locking strip is inserted into said strip groove arranged in the edge portion of said floorboard, the locking strip held in place in said horizontal direction by frictional forces and optionally glue.

5. The locking system for a floorboard as claimed in claim 4, wherein said connectors connect the floorboard with the essentially identical floorboard by snapping-in in an essentially horizontal direction.

6. The locking system for a floorboard as claimed in claim 4, wherein the floorboard is quadrilateral and, along at least two mutually perpendicular edge portions, has a first set of connectors and a second set of connectors.

7. The locking system for a floorboard as claimed in claim 6, wherein said first set of connectors are arranged on a short side of the floorboard and said second set of connectors are arranged on a long side of the floorboard, said first set of connectors differing from said second set of connectors in terms of material property or material composition.

8. The locking system for a floorboard as claimed in claim 7, a locking strip included in said first set of connectors differs in terms of material property or material composition from a locking strip included in said second set of connectors.

9. The locking system for a floorboard as claimed in claim 8, wherein the locking strip included in said first set of connectors has higher strength than the locking strip included in said second set of connecting means.

10. The locking system for a floorboard as claimed in claim 3, comprising a first locking surface arranged in said strip groove and adapted to cooperate with a second locking surface arranged on said locking strip.

11. The locking system for a floorboard as claimed in claim 10, wherein the floorboard is quadrilateral and, along at least two mutually perpendicular edge portions, has a first set of connectors and a second set of connectors.

12. The locking system for a floorboard as claimed in claim 10, wherein said first locking surface is arranged on a lower lip which defines said strip groove, and that said second locking surface is arranged on a lower surface of said locking strip.

13. The locking system for a floorboard as claimed in claim 12, wherein the locking strip is detachable from said floorboard by an angular motion in a direction opposite to said inward angling.

14. The locking system for a floorboard as claimed in claim 1, wherein said wood-based material is impregnated and/or coated with a property-improving agent.

15. The locking system for a floorboard as claimed in claim 1, comprising a strip groove in the floorboard to receive a strip locking element of said locking strip and a tongue groove in the floorboard to receive a strip tongue of said locking strip, wherein said tongue groove and said strip tongue form a connection in a vertical direction perpendicular to a principal plane of the floorboard.

16. The locking system for a floorboard as claimed in claim 15, wherein the locking strip is inserted into said strip groove arranged in the edge portion of said floorboard, the locking strip held in place in said horizontal direction by frictional forces and optionally glue.

17. The locking system for a floorboard as claimed in claim 16, wherein said connectors connect the floorboard with the essentially identical floorboard by snapping-in in an essentially horizontal direction.

18. The locking system for a floorboard as claimed in claim 16, wherein the floorboard is quadrilateral and, along at least two mutually perpendicular edge portions, has a first set of connectors and a second set of connectors.

19. The locking system for a floorboard as claimed in claim 18, wherein said first set of connectors are arranged on a short side of the floorboard and said second set of connectors are arranged on a long side of the floorboard, said first set of connectors differing from said second set of connectors in terms of material property or material composition.

20. The locking system for a floorboard as claimed in claim 19, a locking strip included in said first set of connectors differs in terms of material property or material composition from a locking strip included in said second set of connectors.

21. The locking system for a floorboard as claimed in claim 20, wherein the locking strip included in said first set of connectors has higher strength than the locking strip included in said second set of connecting means.

22. The locking system for a floorboard as claimed in claim 15, comprising a first locking surface arranged in said strip groove and adapted to cooperate with a second locking surface arranged on said locking strip.

23. The locking system for a floorboard as claimed in claim 22, wherein the floorboard is quadrilateral and, along at least two mutually perpendicular edge portions, has a first set of connectors and a second set of connectors.

24. The locking system for a floorboard as claimed in claim 22, wherein said first locking surface is arranged on a lower lip which defines said strip groove, and that said second locking surface is arranged on a lower surface of said locking strip.

25. The locking system for a floorboard as claimed in claim 24, wherein the locking strip is detachable from said floorboard by an angular motion in a direction opposite to said inward angling.

26. The locking system for a floorboard as claimed in claim 1, wherein the locking strip and the downward open locking groove are designed for connecting the floorboard with the essentially identical floorboard by at least inward angling.

27. The locking system for a floorboard as claimed in claim 1, wherein the locking strip and the downward open locking groove are designed so that the locking element enters the downward open locking groove from an underside of the essentially identical floorboard.

28. The locking system for a floorboard as claimed in claim 1, wherein lower lips of said floorboard and said essentially identical floorboard in a connected state terminate in spaced-apart relation from each other.

29. The locking system for a floorboard as claimed in claim 1, wherein lower lips of said floorboard and said essentially identical floorboard in a connected state terminate inward from the vertical joint plane in the horizontal direction.

30. The locking system for a floorboard as claimed in claim 1, wherein said locking strip projects past the vertical plane and, in a connected state, projects below a lower lip of said essentially identical floorboard.

31. The locking system for a floorboard as claimed in claim 1, wherein at least one surface of the tongue groove includes said locking strip.

32. The locking system for a floorboard as claimed in claim 31, wherein the at least one surface is a surface of the tongue groove closest to an underside of the floorboard.

33. The locking system for a floorboard as claimed in claim 31, wherein the at least one surface is a surface of the tongue groove that, in a connected state, contacts a lower surface of a tongue arranged on said essentially identical floorboard.

34. The locking system for a floorboard as claimed in claim 31, wherein at least one surface of the tongue groove consists of said locking strip.

35. A method for manufacturing a locking strip and assembling the locking strip with a floorboard, the floorboard including connectors integrated with the floorboard and adapted to connect the floorboard with an essentially identical floorboard, so that upper joint edges of said floorboard and said essentially identical floorboard in a connected state define a vertical plane, said connectors designed to connect said floorboard with said essentially identical floorboard in at least a horizontal direction perpendicular to said vertical plane, said connectors having a locking strip which projects from said vertical plane and carries a locking element which cooperates, in said connected state, with a locking groove which is open at an underside of said essentially identical floorboard, the method comprising:

forming the locking strip as a separate part by machining a sheet-shaped material, the locking strip formed for connecting the floorboard with the essentially identical floorboard by at least inward angling of the floorboard relative to the essentially identical floorboard, and mechanically fixing the locking strip to the floorboard in both a horizontal direction and the vertical direction.

36. The method as claimed in claim 35, comprising fixing the locking strip to the floorboard by snapping-in in an essentially horizontal direction.

37. The method as claimed in claim 35, comprising fixing the locking strip to the floorboard by inward angling.

38. The method as claimed in claim 35, comprising inserting the locking strip into a strip groove arranged in an edge portion of said floorboard, such that the locking strip is held in place in said horizontal direction by frictional forces and optionally glue.

39. The method as claimed in claim 35, wherein said locking strip is included in a strip blank comprising at least two essentially identical locking strips, the locking strip being engaged with the floorboard, and said locking strip being separated from said strip blank.

40. A method for manufacturing a locking strip and assembling the locking strip with a floorboard, the floorboard including connectors integrated with the floorboard and adapted to connect the floorboard with an essentially identical floorboard, so that upper joint edges of said floorboard and said essentially identical floorboard in a connected state define a vertical plane, said connectors designed to connect said floorboard with said essentially identical floorboard in at least a horizontal direction perpendicular to said vertical plane, said connectors having a locking strip which projects from said vertical plane and carries a locking element which cooperates, in said connected state, with a downward open locking groove of said essentially identical floorboard, the method comprising the steps of forming the locking strip as a separate part which is arranged on the floorboard, mechanically fixing the locking strip to the floorboard in both a horizontal direction and the vertical direction, and forming the locking strip by machining of a sheet-shaped material, the locking strip formed for connecting the floorboard with the essentially identical floorboard by at least inward angling of the floorboard relative to the essentially identical floorboard, wherein said locking strip is included in a strip blank comprising at least two essentially identical locking strips, the locking strip being engaged with the floorboard, and said locking strip being separated from said strip blank.

41. The method as claimed in claim 40, comprising fixing the locking strip to the floorboard by snapping-in in an essentially horizontal direction.

42. The method as claimed in claim 40, comprising fixing the locking strip to the floorboard by inward angling.

43. The method as claimed in claim 40, comprising inserting the locking strip into a strip groove arranged in an edge portion of said floorboard, such that the locking strip is held in place in said horizontal direction by frictional forces and optionally glue.

* * * * *